US008126171B2

(12) United States Patent
Sekino et al.

(10) Patent No.: US 8,126,171 B2
(45) **Date of Patent: *Feb. 28, 2012**

(54) ELECTROSTATIC ULTRASONIC TRANSDUCER AND ULTRASONIC SPEAKER

(75) Inventors: Hirokazu Sekino, Chino (JP); Kinya Matsuzawa, Shiojiri (JP); Hideki Kojima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 1406 days.

This patent is subject to a terminal disclaimer.

(21) Appl. No.: 11/677,485

(22) Filed: Feb. 21, 2007

(65) Prior Publication Data

US 2007/0195976 A1 Aug. 23, 2007

(30) Foreign Application Priority Data

Feb. 21, 2006 (JP) ..... 2006-043484
Jan. 29, 2007 (JP) ..... 2007-018182

(51) Int. Cl.
*H04R 25/00* (2006.01)

(52) U.S. Cl. ..... 381/191; 381/190; 381/174; 381/116

(58) Field of Classification Search ..... 381/190, 381/191, 173–175; 257/245, 252, 254, 416–419
See application file for complete search history.

(56) References Cited

U.S. PATENT DOCUMENTS

| | | | | |
|---|---|---|---|---|
| 3,941,946 | A * | 3/1976 | Kawakami et al. | 381/116 |
| 4,533,794 | A * | 8/1985 | Beveridge | 381/174 |
| 4,891,843 | A * | 1/1990 | Paulus et al. | 381/191 |
| 7,668,323 | B2 * | 2/2010 | Miyazaki | 381/190 |
| 7,881,489 | B2 * | 2/2011 | Matsuzawa et al. | 381/396 |
| 7,916,879 | B2 * | 3/2011 | Pedersen | 381/175 |
| 2009/0202088 | A1 * | 8/2009 | Sekino et al. | 381/160 |

FOREIGN PATENT DOCUMENTS

| | | |
|---|---|---|
| JP | 2000-050387 | 2/2000 |
| JP | 2000-050392 | 2/2000 |

* cited by examiner

*Primary Examiner* — Davetta W Goins
*Assistant Examiner* — Jasmine Pritchard
(74) *Attorney, Agent, or Firm* — Maschoff Gilmore & Israelsen

(57) ABSTRACT

An electrostatic ultrasonic transducer includes a first electrode that has through-holes, a second electrode that has through-holes, and a vibrating membrane that is disposed such that the through-holes of the first electrode and the through-holes of the second electrode form a pair, interposed between a pair of electrodes composed of the first electrode and the second electrode, and having a conductive layer applied with a direct current bias voltage. The first electrode and the second electrode each have counter electrode portions that are formed in the through-holes to face the vibrating membrane, and a modulated wave, which is obtained by modulating a carrier wave in an ultrasonic frequency band with a signal wave in an audible frequency band, is applied between the pair of electrodes.

6 Claims, 18 Drawing Sheets

| SPECIFICATION | COUNTER ELECTRODE DIAMETER (mm) | OPENING EXTERNAL DIAMETER (mm) | BRIDGE STRUCTURE | CENTRAL COUNTER ELECTRODE PORTION |
|---|---|---|---|---|
| GENERAL SPECIFICATION | Φ 1.5 mm | Φ 0.75 mm | NONE | NONE |
| FIRST FORM OF THE INVENTION | | Φ 1.5 mm | CROSS SHAPE, WIDTH OF 0.2 mm | NONE |
| SECOND FORM OF THE INVENTION | | | CROSS SHAPE, WIDTH OF 0.2 mm | Φ 0.5 mm |
| THIRD FORM OF THE INVENTION | | | Y SHAPE, WIDTH OF 0.2 mm | NONE |

FIG. 8A

| | | |
|---|---|---|
| THICKNESS OF VIBRATING MEMBRANE | 0.01 mm | |
| PHYSICAL PROPERTY | YOUNG'S MODULUS [Pa] | $3.00 \times 10^{6}$ |
| | POISSON'S RATIO | 0.45 |
| | DENSITY [kg/m$^3$] | $1.40 \times 10^{-6}$ |
| ELECTROSTATIC FORCE | 1.92 mN/mm$^2$ | |

FIG. 8B

EVALUATION RESULT

| SPECIFICATION | VIBRATING MEMBRANE DISPLACEMENT | | EXCLUSION VOLUME |
|---|---|---|---|
| | CENTRAL PORTION OF VIBRATING MEMBRANE | ELECTRODE OPENING | |
| GENERAL SPECIFICATION | 1.00 | 1.00 | 1.00 |
| FIRST FORM OF THE INVENTION | 1.39 | 1.18 | 2.16 |
| SECOND FORM OF THE INVENTION | 1.57 | 1.10 | 1.41 |
| THIRD FORM OF THE INVENTION | 1.12 | 0.99 | 2.90 |

ELECTROSTATIC ULTRASONIC TRANSDUCER AND ULTRASONIC SPEAKER

BACKGROUND

1. Technical Field

The present invention relates to an electrostatic ultrasonic transducer, a method of manufacturing an electrostatic ultrasonic transducer, an ultrasonic speaker, a method of reproducing a sound signal, an super-directivity sound system, and a display device that are capable of improving an output sound pressure by increasing an effective membrane displacement of a vibrating membrane and increasing an opening ratio of radiating holes (through-holes) radiating a sound wave.

2. Related Art

An ultrasonic transducer outputs a modulated wave obtained by modulating a carrier wave in an ultrasonic wave band with a sound signal in an audible band, and reproduces a sound having sharp directivity.

FIGS. 15A and 15B are diagrams illustrating an example of a structure of an ultrasonic transducer according to the related art. Most of ultrasonic transducers according to the relate art are resonance-type ultrasonic transducers using piezoelectric ceramic. A piezoelectric ultrasonic transducer shown in FIG. 15A performs a conversion from an electrical signal to an ultrasonic wave and a conversion from the ultrasonic wave to the electrical signal (transmission and reception of an ultrasonic wave) by using piezoelectric ceramic as a vibration element.

A bimorph-type ultrasonic transducer shown in FIG. 15A includes two sheets of piezoelectric ceramics 61 and 62, a cone 63, a case 64, leads 65 and 66, and a screen 67. The piezoelectric ceramics 61 and 62 are bonded to each other, and the leads 65 and 66 are connected to the surfaces of the piezoelectric ceramics 61 and 62 opposite to the bonding surface between the piezoelectric ceramics 61 and 62.

Since the piezoelectric ultrasonic transducer utilizes a resonance phenomenon of the piezoelectric ceramics, ultrasonic wave transmitting and receiving characteristics become superior in a relatively narrow frequency band near a resonance frequency thereof. However, since the piezoelectric transducer utilizes a sharp resonance characteristic of an element, a high sound pressure is obtained, but a frequency band is extraordinarily narrow. For this reason, a reproducible frequency band is narrow in an ultrasonic speaker that uses the piezoelectric transducer, and a reproducing sound quality becomes deteriorated, as compared with a loud speaker.

Different from the above-described piezoelectric transducer, the electrostatic ultrasonic transducer has been generally known as a wide range oscillation type ultrasonic transducer that can reproduce a high sound pressure over a high frequency band. FIG. 15B shows an example of a structure of a wide band oscillation type electrostatic ultrasonic transducer. The electrostatic ultrasonic transducer is referred to as a pull type, because a vibrating membrane only moves in a direction toward a electrode side.

The electrostatic ultrasonic transducer that is shown in FIG. 15B uses as a vibrator (vibrating membrane), a dielectric 131 (insulator), such as a PET (polyethyleneterephthalate) resin, which has a thickness in a range of about 3 to 10 μm. In regards to the dielectric 131, an upper electrode 132 formed by using a metal foil such as aluminum is integrally formed on a top surface of the dielectric 131 by means of a deposition process or the like, and a lower electrode 133 formed of brass is provided to come into contact with the bottom surface of the dielectric 131. A lead 152 is connected to the lower electrode 133, and the lower electrode 133 is fixed on a base plate 135 that is made of Bakelite.

Further, the upper electrode 132 is connected to a lead 153, and the lead 153 is connected to a direct current bias power supply 150. By means of the direct current bias power supply 150, the upper electrode 132 is always applied with a direct current bias voltage for upper electrode absorption in a range of about 50 to 150 V, and the upper electrode 132 is attracted to the side of the lower electrode 133. Reference numeral 151 indicates a signal source.

The dielectric 131, the upper electrode 132, and the base plate 135 are caulked by a case 130 together with metal rings 136, 137, and 138, and a mesh 139.

A plurality of minute grooves (unevenness portions), which have a size in a range of about several tens to several hundreds of micrometers and an irregular shape, are formed on a surface of the lower electrode 133 at the dielectric 131 side. Since the minute grooves form gaps between the lower electrode 133 and the dielectric 131, the distribution of the capacitance between the upper electrode 132 and the lower electrode 133 is minutely varied. The random minute grooves are formed by manually polishing the surface of the lower electrode 133. In the electrostatic ultrasonic transducer, a plurality of capacitors where sizes or depths of gaps are different are formed, which achieves a wide band of a frequency characteristic (JP-A-2000-50387 and JP-A-2000-50392).

As described above, the electrostatic ultrasonic transducer that is shown in FIG. 15B has been generally known as a wide band ultrasonic transducer (pull type) that can generate a relatively high sound pressure over a wide frequency band.

However, a maximum output sound pressure of the electrostatic ultrasonic transducer is slightly low, it is difficult to obtain an ultrasonic sound pressure necessary when obtaining a parametric array effect, and a ceramic piezoelectric element such as PZT or a high molecular piezoelectric element such as PVDF is used as an ultrasonic generator. However, the piezoelectric element has a sharp resonance point without depending on a type of material thereof, is driven with a resonance frequency, and is put to practical use as an ultrasonic speaker. Therefore, a frequency region capable of ensuring a high sound pressure is very narrow. That is, it has a frequency region of a narrow band.

In order to solve this problem, the applications have suggested the static ultrasonic transducer, as shown in FIGS. 16A and 16B (Japanese Patent Application No. 2004-173946). This structure is generally referred to a push-pull type, and is capable of simultaneously satisfying a wide band and a high sound pressure, as compared with the pull-type electrostatic ultrasonic transducer.

FIGS. 16A and 16B are diagrams illustrating an example of a structure of a push-pull type electrostatic ultrasonic transducer. Specifically, FIG. 16A is a diagram illustrating a sectional structure of a push-pull type electrostatic ultrasonic transducer, and FIG. 16B is a plan view illustrating a electrode when viewed from a vibrating membrane side. FIG. 16A is a cross-sectional view taken along the line X-Y of FIG. 16B.

In FIGS. 16A and 16B, the push-pull type electrostatic ultrasonic transducer includes a pair of electrodes 20 and 21 each having a conductive member formed of a conductive material functioning as an electrode, a vibrating membrane 22 that is interposed between the pair of electrodes 20 and 21 and has a conductive layer (vibrating membrane electrode) 221, and a supporting member 25 that holds the pair of electrodes 20 and 21 and the vibrating membrane 22.

The vibrating membrane 22 has insulating layers 220, and a conductive layer 221 that is formed of a conductive material, and the conductive layer 221 is applied with a direct current bias voltage having a single polarity (both a positive polarity voltage and a negative polarity voltage are possible) by means of a direct current bias power supply 27.

Further, the pair of electrodes 20 and 21 have the same number and a plurality of through-holes 24 at locations facing each other with the vibrating membrane 22 interposed therebetween. Between the conductive members of the pair of electrodes 20 and 21, an alternating current signal is applied by means of the signal sources 28A and 28B. Between the electrode 20 and the conductive layer 221, and between the electrode 21 and the conductive 221, capacitors are respectively formed.

According to this configuration, in the electrostatic ultrasonic transducer, the conductive layer 221 of the vibrating membrane 22 is applied with the direct current bias voltage having a single polarity (in this example, positive polarity) by mans of the direct current bias power supply 27. Meanwhile, the pair of electrodes 20 and 21 are applied with the alternating current signal by mans of the signal sources 28A and 28B. As a result, since the positive voltage is applied to the electrode 20 during a positive half cycle of the alternating current signal output from the signal sources 28A and 28B, an electrostatic repulsive force acts in a surface portion 23A of the vibrating membrane 22 that is not interposed between the electrodes of the vibrating membrane 22, and the surface portion 23A extends downward in FIG. 16A. At this time, since the negative voltage is applied to the electrode 21 that faces the electrode 20, an electrostatic absorption force acts in a rear surface portion 23B at the rear surface side of the vibrating membrane 22, and the rear surface portion 23B extends downward in FIG. 16.

Accordingly, a membrane portion of the vibrating membrane 22 that is not interposed between the pair of electrodes 20 and 21 is applied with an electrostatic repulsive force and electrostatic repulsion in the same direction. In the same manner with respect to the negative half cycle of the alternating current signal that is output from the signal sources 28A and 28B, in FIG. 16A, the electrostatic absorption force acts upward in the surface portion 23A of the vibration membrane 22, and the electrostatic repulsive force acts upward in the rear surface portion 23B in FIG. 16A. A membrane portion of the vibrating membrane 22 that is not interposed between the pair of electrodes 20 and 21 is applied with an electrostatic repulsive force and electrostatic repulsion in the same direction. In this way, while the vibrating membrane 22 is applied with the electrostatic repulsive force and the electrostatic repulsion in the same direction as the polarity of the alternating current signal is varied, a direction where the electrostatic force alternately acts is varied. Therefore, it is possible to generate a sound signal having a sufficient sound pressure level that is necessary when obtaining a strong membrane vibration, that is, the parametric array effect.

As such, the ultrasonic transducer that is shown in FIGS. 16A and 16B is referred to as a push-pull type because the vibrating membrane 22 receives a force from the pair of electrodes 20 and 21 and vibrates. The push-pull type electrostatic ultrasonic transducer has a capability that is capable of simultaneously achieving a wide band and a high sound pressure, as compared with the pull type electrostatic ultrasonic transducer where the electrostatic absorption force is only applied to the vibrating membrane.

As described above, in the push-pull type electrostatic ultrasonic transducer, a high direct current bias voltage is applied to the vibrating membrane and the alternating current voltage is applied to the electrodes, and thus the membrane portion vibrates due to an electrostatic force (attraction or repulsion) that is applied to the electrode and the vibrating membrane. In this case, in order to achieve the vibration in the ultrasonic wave band, the diameter of the hole of the vibrating portion needs to be several mm or less. For example, as shown in FIG. 17, it is required to form a transducer having a high following characteristic and a high output characteristic by providing the plurality of through-holes (vibration holes) 24 on the electrode 20.

FIGS. 18A to 18C are diagrams illustrating a structure of a electrode that is used in a push-pull type electrostatic ultrasonic transducer shown in FIGS. 16A and 16B and a process for manufacturing the electrode.

As described above, the electrode needs to be provided with the through-holes for radiating the sound wave, and through-holes of 1000 or more may be formed. The mechanical processing is suitable in terms of processing precision, but since instead of the mechanical processing, the etching is used because of the problem of the cost. However, there is a restriction between the diameter of the through-hole formed by the etching and the thickness. For example, it is difficult to manufacture with the etching process, the electrodes that have the through-hole diameter of 0.75 mm and the thickness of 1.5 mm and satisfy the predetermined processing precision.

Accordingly, as shown in FIG. 18A, a mask member 201 for forming the predetermined through-holes 203 is coated on a conductor (it is generally metal, and copper or stainless can be used as the conductor) 202 that has the thickness sufficiently smaller than the diameter of the through-hole, for example, the thickness of 0.25 mm, which is then subjected to the etching process. In this way, the plurality of conductors 202 are prepared in which the through-holes 203 are formed.

In addition, as shown in FIG. 18B, when the total thickness of the conductors is 1.5 mm, six sheets of conductors 202 are laminated in a state where all of the through-holes 203 are aligned. As shown in FIG. 18C, in a state where the laminated conductors 202 are pressed from both sides, the laminated conductors 202 are subjected to a thermal compressing process or a dispersion bonding process. As a result, it is possible to form an integral (metal-coupled) electrode having the thickness of 1.5 mm. FIGS. 18A and 18B show an example where square electrodes are manufactured. However, when the circular electrodes are manufactured, the circular conductor 202 is used.

Meanwhile, as described above, a plurality of through-holes for radiating the sound wave need to be formed in the electrodes of the electrostatic ultrasonic transducer. In this case, as shown in FIG. 16B, around the through-holes 24, the counter electrode portions 26 are disposed to make the electrostatic force applied to the vibrating membrane, and the electrostatic force is applied between the counter electrode portion 26 and the vibration region of the vibrating membrane 22 (portion of the vibrating membrane that is not interposed between the electrodes).

In this case, the diameter D1 of the through-hole 24 is set to half the diameter D2 of the electrode that forms the counter electrode portion 26. This relationship is set such that the relationship between the radiating efficiency of the sound wave and the membrane vibration amplitude becomes most excellent. For example, if the diameter of the through-hole becomes smaller (that is, if the area of the counter electrode portion 26 becomes larger), the electrostatic force becomes stronger, which increases the membrane vibration amplitude. However, the radiating area of the sound wave is decreased, which lowers the radiating sound pressure. Meanwhile, if the diameter of the through-hole becomes larger (that is, if the area of the counter electrode portion 26 becomes smaller), the radiating area of the sound wave is increased. However, since the electrostatic force becomes weaker, the membrane vibration amplitude is decreased, which lowers the radiating sound pressure.

The transducer is constructed according to the above-described relationships. However, in the structure according to the related art shown in FIG. 16B, the electrostatic force that is applied to the vibrating membrane is only applied to the outer circumferential portion of the vibration region, and it is difficult to generate the membrane vibration with high efficiency.

As described above, in the push-pull type electrostatic ultrasonic transducer according to the related art, the electrostatic force that is applied to the vibrating membrane is only applied to the outer circumferential portion of the vibration region, and it is difficult to generate the membrane vibration with high efficiency.

SUMMARY

An advantage of some aspects of the invention is that it provides an electrostatic ultrasonic transducer, a method of manufacturing an electrostatic ultrasonic transducer, an ultrasonic speaker, a method of reproducing a sound signal, and super-directivity sound system, and a display device that are capable of improving an output sound pressure by increasing an effective membrane displacement of a vibration membrane and increasing an opening ratio of radiating holes (through-holes) radiating an ultrasonic wave.

According to a first aspect of the invention, an electrostatic ultrasonic transducer includes a first electrode that has through-holes, a second electrode that has through-holes, and a vibrating membrane that is disposed such that the through-holes of the first electrode and the through-holes of the second electrode form a pair, interposed between a pair of electrodes composed of the first electrode and the second electrode, and having a conductive layer applied with a direct current bias voltage. The first electrode and the second electrode each have counter electrode portions that are formed in the through-holes to face the vibrating membrane, and a modulated wave, which is obtained by modulating a carrier wave in an ultrasonic frequency band with a signal wave in an audible frequency band, is applied between the pair of electrodes.

According to this configuration, the counter electrode portions are disposed in the through-holes to face the vibration region of the vibrating membrane (portion of the vibrating membrane that faces the through-holes).

Therefore, a membrane vibration amplitude of the vibration region of the vibrating membrane can be increased. Further, the counter electrode portions are formed in the through-holes, and thus the diameter of the through-hole can be increased. As a result, an opening ratio can be increased and an output sound pressure can be improved.

Preferably, the counter electrode portions have a bridge structure that builds a bridge between an outer circumferential portion and an inner portion of the through-hole.

According to this structure, the counter electrode portion is constructed to have the bridge structure that passes through the center of the through-hole and crosses the through-hole. In addition, the bridge is set to have a small width, and the counter electrode portion is constructed not to hinder the sound wave radiation from the vibrating membrane.

Therefore, the membrane vibration amplitude of the vibration region of the vibrating membrane can be increased. The counter electrode portion is constructed not to hinder the sound wave radiation, and thus an opening ratio can be increased.

Preferably, the bridge structure is a cross-shaped structure.

Accordingly, the membrane vibration amplitude of the vibration region of the vibrating membrane can be increased. Further, the counter electrode portion is constructed not to hinder the sound wave radiation, and thus an opening ratio can be increased.

Preferably, the bridge structure is a cross-shaped structure, and a central counter electrode portion, which is wider than the bridge structure, is provided at a central portion of the cross-shaped structure.

According to this configuration, the counter electrode portion has the cross-shaped bridge structure, and the central counter electrode portion, which is wider than the bridge, is disposed at the central portion of the cross-shaped structure.

Therefore, the membrane vibration amplitude of the vibration region of the vibrating membrane can be further increased.

Preferably, the bridge structure is a Y-shaped structure.

Therefore, the membrane vibration amplitude of the vibration region of the vibrating membrane can be increased and an opening ratio can be further increased.

According to a second aspect of the invention, there is provided a method of manufacturing an electrostatic ultrasonic transducer which includes a first electrode that has through-holes, a second electrode that has through-holes, and a vibrating membrane that is disposed such that the through-holes of the first electrode and the through-holes of the second electrode form a pair, interposed between a pair of electrodes composed of the first electrode and the second electrode, and having a conductive layer applied with a direct current bias voltage, the first electrode and the second electrode each having counter electrode portions that are formed in the through-holes to face the vibrating membrane, a modulated wave obtained by modulating a carrier wave in an ultrasonic frequency band with a signal wave in an audible frequency band being applied between the pair of electrodes. The method includes manufacturing a conductive electrode base material where the counter electrode portions facing a vibration region of the vibrating membrane are formed in the through-holes, disposing a mask member masking regions of the through-holes of the conductive electrode base material and neighboring regions of the through-holes on one surface of the conductive electrode base material, setting a counter electrode forming material for forming an insulating counter electrode forming body to the one surface of the conductive electrode base material where the mask member is disposed, and coating the counter electrode forming material on a portion of the one surface of the conductive electrode base material which is not masked by the mask member, and separating the mask member after the counter electrode forming material is completely coated, and drying the counter electrode forming body formed on the one surface of the conductive electrode base material.

According to this configuration, the conductive electrode base material is prepared in which the counter electrode portions are formed in the through-holes. In addition, the screen for masking the region of the through-hole and the peripheral regions of the through-holes (mask member for forming a counter electrode forming body to be an insulator on a surface of the conductive electrode base material) is set to one surface of the conductive electrode base material, and by moving a squeegee, the counter electrode forming material to be the insulator is coated to a portion of the conductive electrode base material which is not masked by the mask member. The counter electrode forming material is a material that can be permanently constructed as the counter electrode forming body, and has a non-conductive property. For example, the counter electrode forming material is a masking ink that is used as liquid solder resist for packaging or resist for sand blast generally used in a circuit board. In addition, the screen for forming the counter electrode is separated after the coating process is completed, the counter electrode forming body is dried, and a desired electrode is formed.

As a result, when manufacturing the electrodes of the electrostatic ultrasonic transducer, the counter electrode forming body can be easily formed on the surface of the conductive electrode base material. Accordingly, it is possible to reduce the manufacture cost of the electrostatic ultrasonic transducer.

Preferably, the conductive electrode base material is constructed by laminating flat conductive materials each having a plurality of through-holes and counter electrode portions formed in the plurality of through-holes.

According to this configuration, when the conductive electrode base material is manufactured, the flat conductor materials having the through-holes and the counter electrode portions formed in the thorough-holes are formed by an etching process. The flat conductor materials are laminated, thereby manufacturing a conductive electrode base material.

Therefore, it is possible to easily manufacture the conductive electrode base material that has a predetermined thickness.

According to a third aspect of the invention, an ultrasonic speaker includes an electrostatic ultrasonic transducer that includes a first electrode that has through-holes, a second electrode that has through-holes, and a vibrating membrane that is disposed such that the through-holes of the first electrode and the through-holes of the second electrode form a pair, interposed between a pair of electrodes composed of the first electrode and the second electrode, and having a conductive layer applied with a direct current bias voltage, the first electrode and the second electrode each having counter electrode portions that are formed in the through-holes to face the vibrating membrane, a modulated wave obtained by modulating a carrier wave in an ultrasonic frequency band with a signal wave in an audible frequency band being applied between the pair of electrodes, a signal source that generates a signal wave in an audible frequency band, a carrier wave supply unit that generates a carrier wave in an ultrasonic frequency band and outputs the carrier wave, and a modulating unit that modulates the carrier wave with the signal wave in the audible frequency band output by the signal source. The electrostatic ultrasonic transducer is driven by a modulated signal that is applied between the pair of electrodes and an electrode layer of the vibrating membrane and is output from the modulating unit.

Therefore, it is possible to improve the output sound pressure of the ultrasonic speaker.

According to a fourth aspect of the invention, there is provided a method of reproducing a sound signal using an electrostatic ultrasonic transducer which includes a first electrode that has through-holes, a second electrode that has through-holes, and a vibrating membrane that is disposed such that the through-holes of the first electrode and the through-holes of the second electrode form a pair, interposed between a pair of electrodes composed of the first electrode and the second electrode, and having a conductive layer applied with a direct current bias voltage, the first electrode and the second electrode each having counter electrode portions formed in the through-holes to face the vibrating membrane, a modulated wave obtained by modulating a carrier wave in an ultrasonic frequency band with a signal wave in an audible frequency band being applied between the pair of electrodes. The method includes causing a signal source to generate a signal wave in an audible frequency band, causing a carrier wave supply unit to generate a carrier wave in an ultrasonic frequency band and output the carrier wave, generating a modulated signal by causing a modulating unit to modulate the carrier wave with the signal wave in the audible frequency band, and driving the electrostatic ultrasonic transducer by applying the modulated signal between the electrodes and an electrode layer of the vibrating membrane.

According to the method of reproducing a sound signal using an electrostatic ultrasonic transducer according to the fourth aspect of the invention including the above-described processes, the signal source generates the signal wave in the audible frequency band, and the carrier wave supply source generates the carrier wave in the ultrasonic frequency band and outputs it. In addition, the modulating unit modulates the carrier wave with the signal wave in the audible frequency band, the modulated signal is applied between the electrodes and the electrode layer of the vibrating membrane, and the electrostatic ultrasonic transducer is driven.

Therefore, when using the electrostatic ultrasonic transducer having the above-described structure, a low voltage can be applied between the electrodes, the membrane vibration can be increased, it is possible to output the sound signal having a sufficiently high sound pressure level in obtaining a parametric array effect over a wide frequency band, and the sound signal can be reproduced.

Further, the method of reproducing the sound signal using the electrostatic ultrasonic transducer according to the fourth aspect of the invention uses the electrostatic ultrasonic transducer that is constructed such that the pair of electrodes have the counter electrode portions formed in the through-holes to face the vibrating membrane, that is, the counter electrode portions are disposed in the through-holes to face the vibration region of the vibrating membrane (portion of the vibrating membrane that faces the through-hole), it is possible to increase the membrane vibration amplitude of the vibration region of the vibrating membrane. Further, when the counter electrode portions are formed in the through-holes, the diameter of the through-hole can be increased. Therefore, the opening ratio can be increased, and the output sound pressure can be improved.

According to a fifth aspect of the invention, an super-directivity sound system includes an ultrasonic speaker that is constructed by using an electrostatic ultrasonic transducer and reproduces a sound signal of a first sound area among sound signals supplied from a sound source, the electrostatic ultrasonic transducer including a first electrode that has through-holes, a second electrode that has through-holes, and a vibrating membrane that is disposed such that the through-holes of the first electrode and the through-holes of the second electrode form a pair, interposed between a pair of electrodes composed of the first electrode and the second electrode, and a having conductive layer applied with a direct current bias voltage, the first electrode and the second electrode each having counter electrode portions formed in the through-holes to face the vibrating membrane, a modulated wave obtained by modulating a carrier wave in an ultrasonic frequency band with a signal wave in an audible frequency band being applied between the pair of electrodes, and a reproducing speaker that reproduces a sound signal of a second sound area among the sound signals supplied from the sound source. The ultrasonic speaker reproduces the sound signals supplied from the sound source, and a virtual sound source is formed in the vicinity of a sound wave reflecting surface, such as a screen.

The super-directivity sound system according to the fifth aspect of the invention uses the ultrasonic speaker that includes an electrostatic ultrasonic transducer, the electrostatic ultrasonic transducer including a first electrode that has through-holes, a second electrode that has through-holes, and a vibrating membrane that is disposed such that the through-holes of the first electrode and the through-holes of the second electrode form a pair, is interposed between a pair of electrodes composed of the first electrode and the second electrode, and a conductive layer applied with a direct current bias voltage, the first electrode and the second electrode each having counter electrode portions formed in the through-holes in a state where the counter electrode portions face the vibrating membrane, and a modulated wave obtained by modulating a carrier wave in an ultrasonic frequency band with a signal wave in an audible frequency band being applied between the pair of electrodes. In addition, the ultrasonic speaker reproduces the sound signals of the intermediate and high sound areas among the sound signals supplied from the sound source. The sound signal of the low sound area among the sound signals that are supplied from the sound source is reproduced by the low sound reproducing speaker.

Accordingly, while the sound of the first sound area (intermediate and high sound) has the sufficient sound pressure and the wide band characteristic in a state where the low voltage is applied between the electrodes of the electrostatic ultrasonic transducer and the sound pressure characteristic is improved, the sound can be reproduced such that the it is generated from the virtual sound source formed in the vicinity of the sound wave reflecting surface, such as the screen. Further, since the sound in the second sound area (low sound area) is directly output from the reproducing speaker included in the super-directivity sound system, the low sound area can be reinforced, and a realistic sound field environment can be constructed.

Further, the super-directivity sound system according to the fifth aspect of the invention uses the electrostatic ultrasonic transducer constructed such that the pair of electrodes have the counter electrode portions formed in the through-holes to face the vibrating membrane, that is, the counter electrode portions are disposed in the through-holes to face the vibration region of the vibrating membrane (portion of the vibrating membrane that faces the through-holes). Therefore, it is possible to increase the membrane vibration amplitude of the vibration region of the vibrating membrane. Further, when the counter electrode portions are formed in the through-holes, the diameter of the through-hole can be increased. As a result, the opening ratio can be increased, and the output sound pressure can be improved.

According to a sixth aspect of the invention, a display device includes an ultrasonic speaker that includes an electrostatic ultrasonic transducer and reproduces a signal sound of an audible frequency band from sound signals supplied by a sound source, the electrostatic ultrasonic transducer including a first electrode that has through-holes, a second electrode that has through-holes, and a vibrating membrane that is disposed such that the through-holes of the first electrode and the through-holes of the second electrode form a pair, interposed between a pair of electrodes composed of the first electrode and the second electrode, and having a conductive layer applied with a direct current bias voltage, the first electrode and the second electrode each having counter electrode portions formed in the through-holes to face the vibrating membrane, a modulated wave obtained by modulating a carrier wave in an ultrasonic frequency band with a signal wave in an audible frequency band being applied between the pair of electrodes, and a projection optical system that projects an image onto a projection surface.

The display device according to the sixth aspect of the invention that has the above-described structure uses an ultrasonic speaker that includes an electrostatic ultrasonic transducer, the electrostatic ultrasonic transducer including a first electrode that has through-holes, a second electrode that has through-holes, and a vibrating membrane that is disposed such that the through-holes of the first electrode and the through-holes of the second electrode form a pair, interposed between a pair of electrodes composed of the first electrode and the second electrode, and a conductive layer applied with a direct current bias voltage, the first electrode and the second electrode each having counter electrode portions formed in the through-holes in a state where the counter electrode portions face the vibrating membrane, a modulated wave obtained by modulating a carrier wave in an ultrasonic frequency band with a signal wave in an audible frequency band being applied between the pair of electrodes, and a projection optical system that projects an image onto a projection surface. In addition, the ultrasonic speaker reproduces the sound signal that is supplied from the sound source.

As a result, while the sound signal has the sufficient sound pressure and the wide band characteristic in a state where the sound pressure characteristic is improved, the sound signal can be reproduced such that the it is generated from the virtual sound source formed in the vicinity of the sound wave reflecting surface, such as the screen. Therefore, the reproducing range of the sound signal can be easily controlled. Further, it is possible to control the directivity of the sound that is radiated from the ultrasonic speaker.

Further, the super-directivity sound system according to the sixth aspect of the invention uses the electrostatic ultrasonic transducer constructed such that the pair of electrodes have the counter electrode portions formed in the through-holes to face the vibrating membrane, that is, the counter electrode portions are disposed in the through-holes to face the vibration region of the vibrating membrane (portion of the vibrating membrane that faces the through-holes). Therefore, it is possible to increase the membrane vibration amplitude of the vibration region of the vibrating membrane. Further, when the counter electrode portions are formed in the through-holes, the diameter of the through-hole can be increased. As a result, the opening ratio can be increased, and the output sound pressure can be improved.

BRIEF DESCRIPTION OF THE DRAWINGS

The invention will be described with reference to the accompanying drawings, where like numbers reference like elements.

FIGS. 8A and 8B are diagrams illustrating specifications and evaluation conditions of a counter electrode portion.

DESCRIPTION OF EXEMPLARY EMBODIMENTS

Hereinafter, the preferred embodiments of the invention will be described with reference to the accompanying drawings.

Figure 1A:
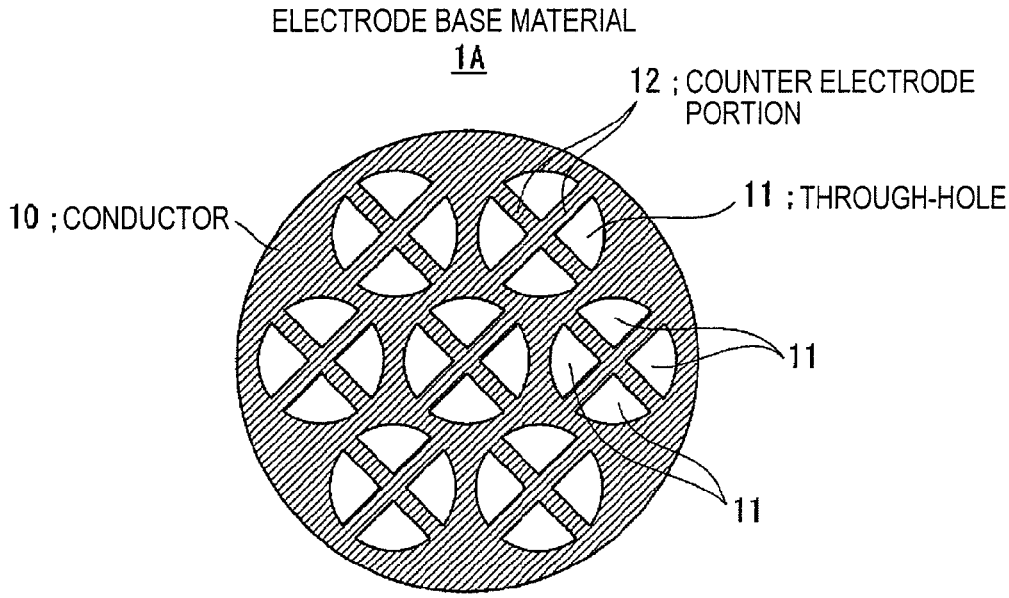
FIGS. 1A and 1B are diagrams illustrating an example of a counter electrode portion of a cross-shaped bridge structure according to an embodiment of the invention.
Figure 1B:
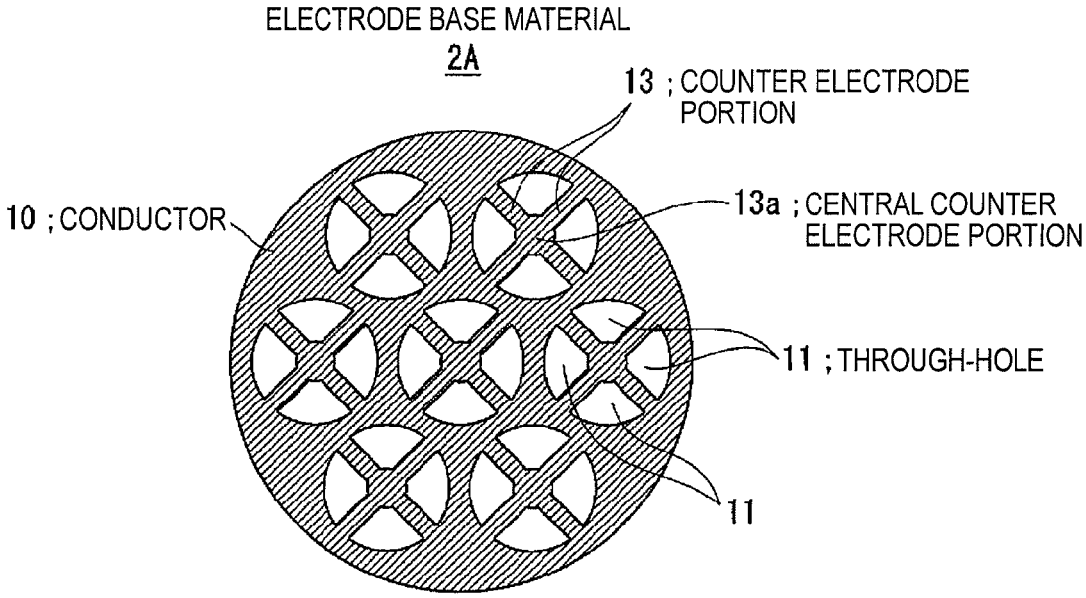
Figure 2:
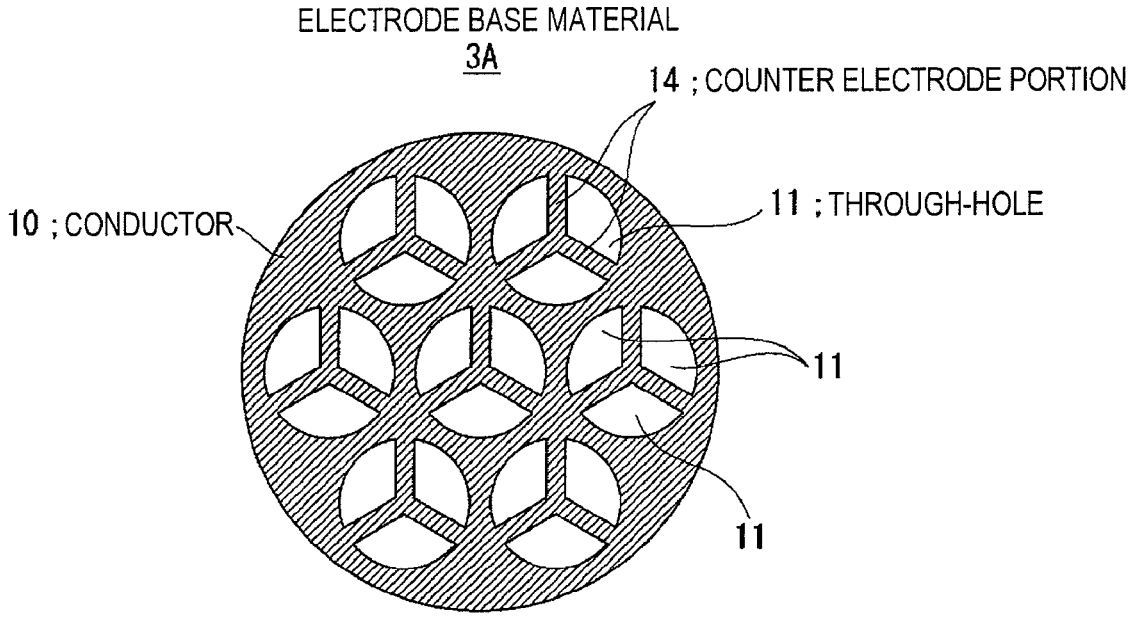
FIG. 2 is a diagram illustrating an example of a counter electrode portion of a Y-shaped bridge structure according to an embodiment of the invention.

FIGS. 1A, 1B, and 2 are diagrams illustrating an example of a structure of a counter electrode portion of a electrode of an electrostatic ultrasonic transducer according to an embodiment of the invention, and are perspective views of a electrode base material that is a conductive member for manufacturing the electrode.

FIG. 1A is a diagram illustrating a counter electrode portion according to a first embodiment of the invention, and illustrates an example of when counter electrode portions 12 having a cross-shaped bridge structure are disposed in through-holes 11 of a electrode base material 1A that is formed of a conductor 10. In this case, the bridge structure means a structure in which the counter electrode portions 12 build bridges between outer circumferential portions and inner portions of the through-holes 11, when the electrodes and the vibrating membrane are assembled so as to form the ultrasonic transducer, as apparent from FIG. 6 that shows an assembled state of the ultrasonic transducer.

FIG. 1B is a diagram illustrating a counter electrode portion according to a second embodiment of the invention, and illustrates an example of when counter electrode portions 13, which form a cross-shaped bridge structure and have a structure where a central portion thereof (central counter electrode portion 13*a*) is wider than a bridge, are disposed in through-holes 11 of a electrode base material 2A that is formed of a conductor 10.

FIG. 2 is a diagram illustrating a counter electrode portion according to a third embodiment of the invention, and illustrates an example of when counter electrode portions 14 each having a Y-shaped bridge structure are disposed in through-holes 11 of a electrode base material 3A.

Since it is very difficult to form the bridge structure through mechanical processing, it is preferable that an etching process be applied to a case where the bridge structure is formed. Further, there is a restriction in the relationships between the diameter of the through-hole formed by etching and the thickness of the base material to be processed. When forming a electrode that has the thickness larger than the diameter of the through-hole, a general method is used, as shown in FIGS. 18A to 18C.

Figures 18A, 18B, 18C:
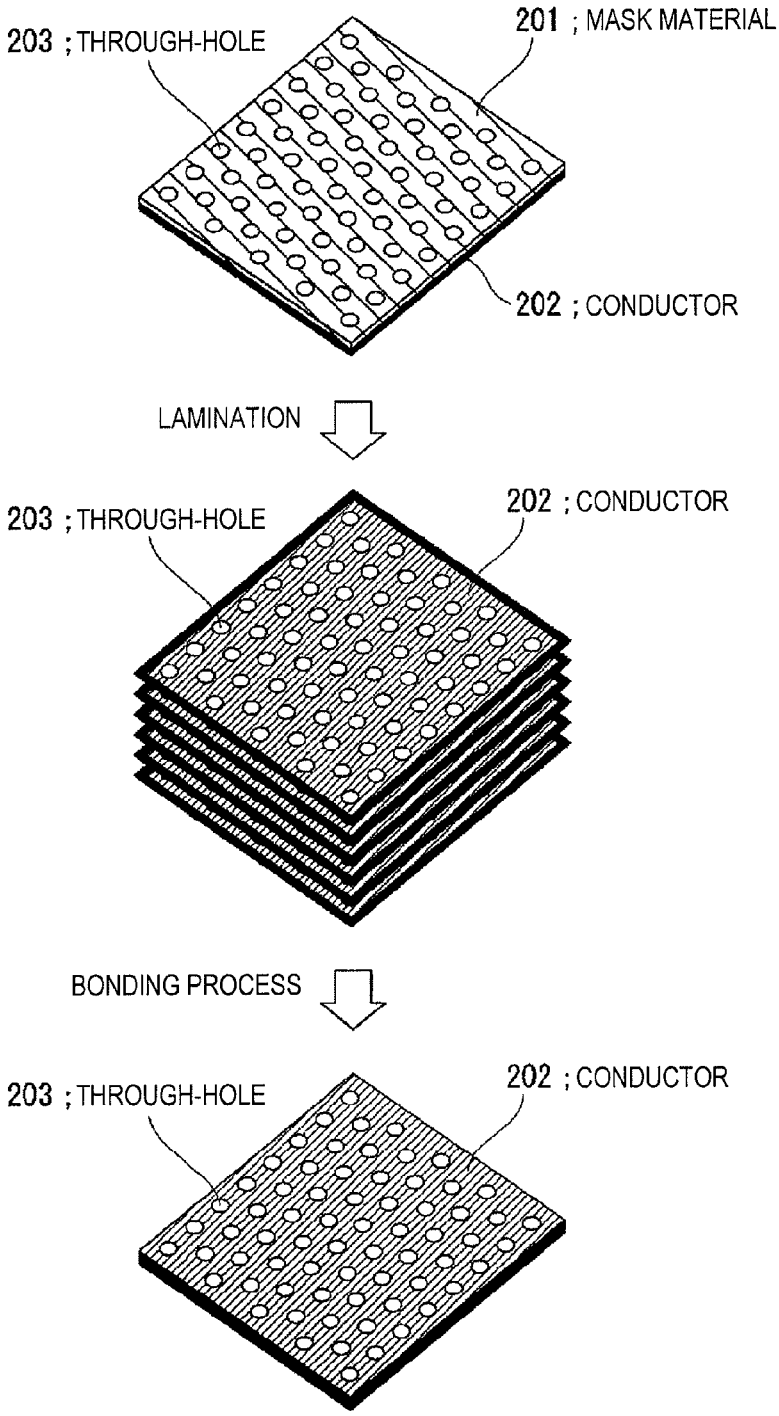
FIGS. 18A to 18C are diagrams illustrating a structure of a electrode and a process for manufacturing the electrode.

FIGS. 18A to 18C show an example of a case where a through-hole has a circular shape. However, in order to form the counter electrode portion of the electrode according to the embodiment of the invention, the bridge structure may be formed in the through-holes. This configuration is achieved through the following processes.

In a first process, a conductor (copper or stainless) that has the thickness smaller than the diameter of the through-hole is coated with a mask member for forming desired counter electrode portions (that is, bridge structures), and an etching process is then performed thereon. Then, a plurality of conductors having been subjected to the above-described process are prepared.

In a second process, the counter electrode portions of the conductors are aligned and are then laminated to have a predetermined electrode thickness.

In a third process, the laminator is pressed from both sides, and is subjected to a thermal compressing process or a dispersion bonding process. Then, an integral electrode is completed.

The above example is constructed such that the thicknesses of the counter electrode portions 12, 13, and 14 are the same as the thicknesses of the electrode base materials 1A, 2A, and 3A. The invention is not limited to the above-described structure. For example, the counter electrode portions having the small thicknesses may be only formed on the one surface (for example, surface facing the vibrating membrane) of the electrode base materials 1A, 2A, and 3A.

Figure 3A:
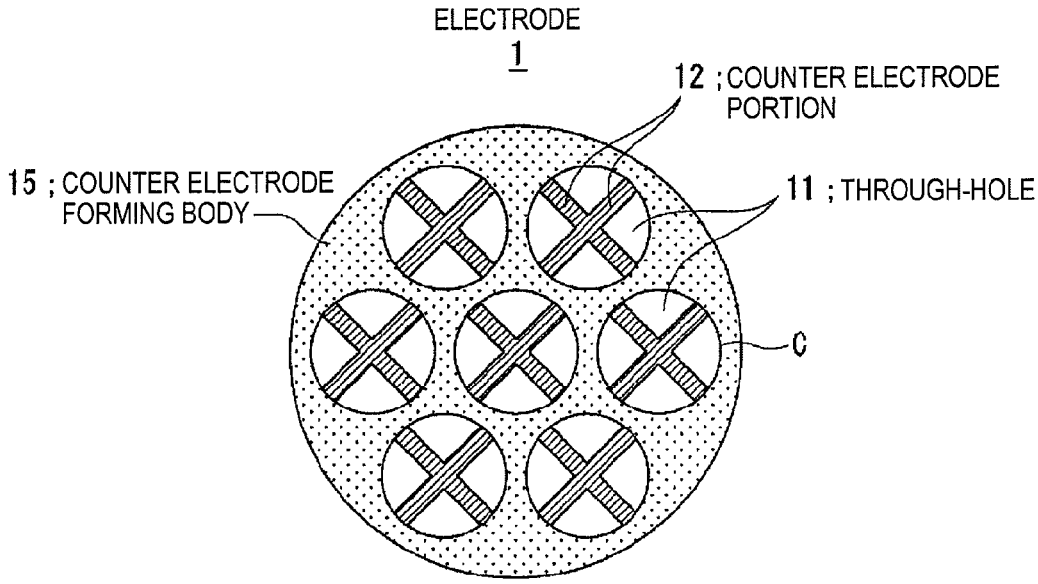
FIGS. 3A and 3B are diagrams illustrating an example of a electrode that has a counter electrode portion of a cross-shaped bridge structure.
Figure 3B:
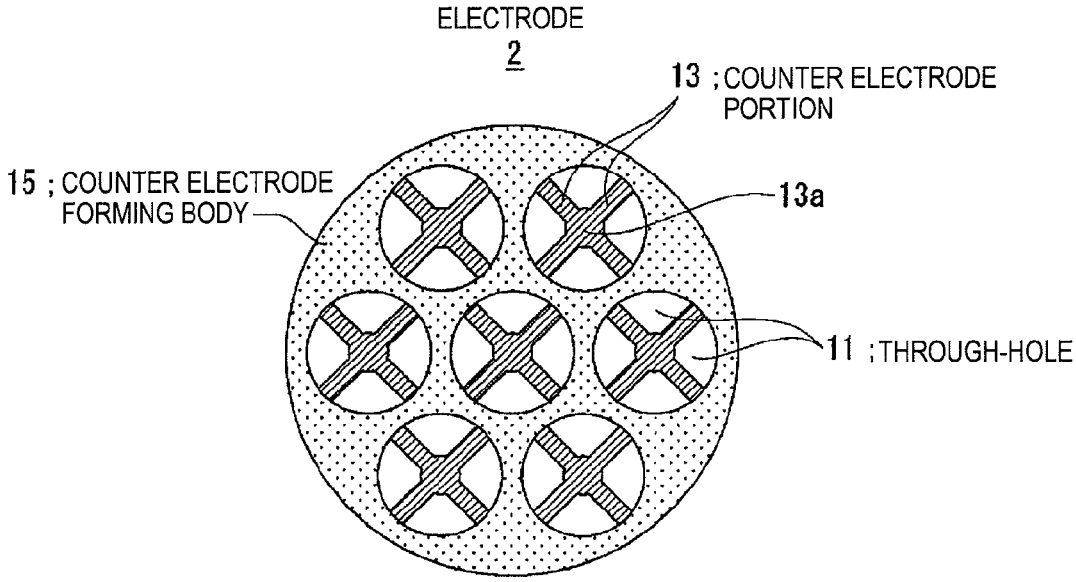
Figure 4:
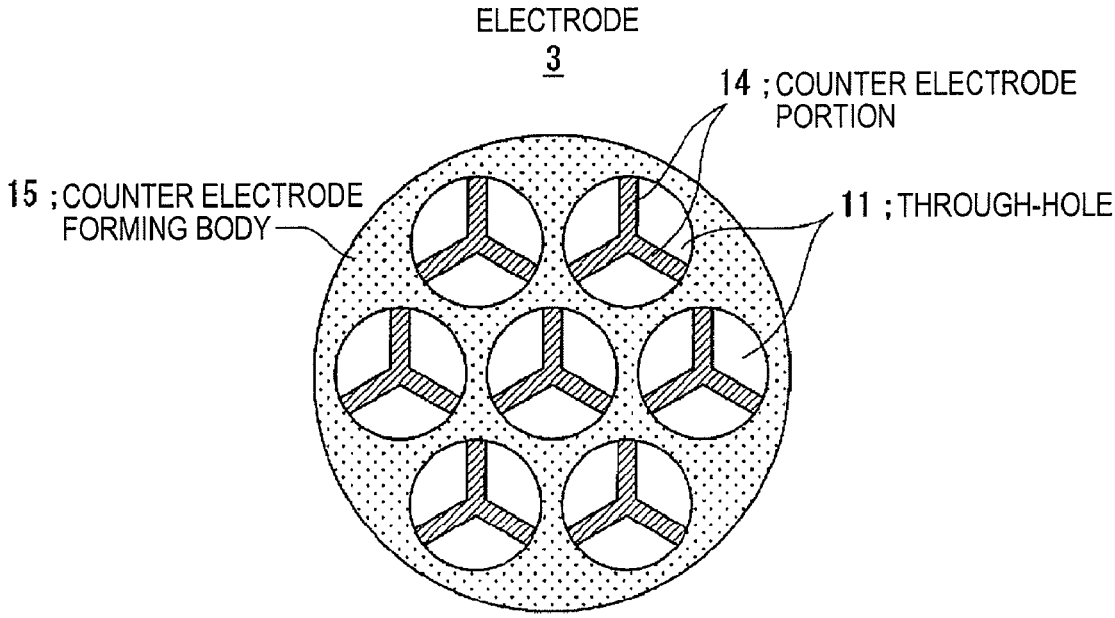
FIG. 4 is a diagram illustrating an example of a electrode having a counter electrode portion of a Y-shaped bridge structure.

FIGS. 3A, 3B, and 4 are perspective views illustrating a final form of a electrode that forms an ultrasonic transducer according to an embodiment of the invention.

A electrode 1 that is shown in FIG. 3A is obtained by forming a counter electrode forming body 15 as an insulator on one surface of the electrode base material 1A shown in FIG. 1A.

A electrode 2 that is shown in FIG. 3B is obtained by forming a counter electrode forming body 15 as an insulator on one surface of the electrode base material 2A shown in FIG. 1B.

A electrode 3 that is shown in FIG. 4 is obtained by forming a counter electrode forming body 15 as an insulator on one surface of the electrode base material 3A shown in FIG. 2.

Figure 5A:
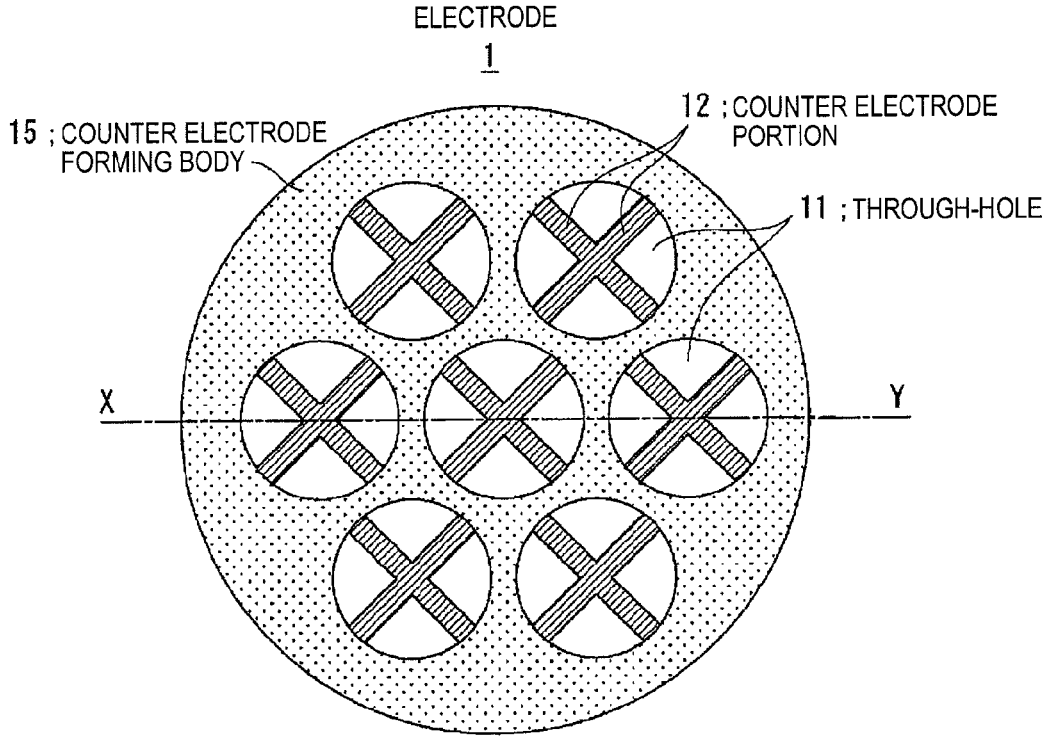
FIGS. 5A and 5B are diagrams illustrating a sectional structure of a electrode 1 shown in FIG. 3A.
Figure 5B:
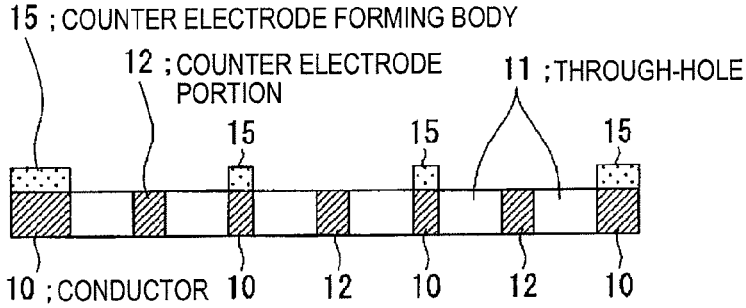

FIGS. 5A and 5B are diagrams illustrating a sectional structure of a electrode 1 shown in FIG. 3A. The sectional structure diagram shown in FIG. 5B is a cross-sectional view taken along the line X-Y in FIG. 5A.

As shown in FIG. 5B, the counter electrode forming body 15 as the insulator is formed on an entire region of the remaining portion of the conductor 10, except for the bridge structure that forms the counter electrode portion 12, and thus a electrode 1 having a predetermined structure is formed.

Figure 6:
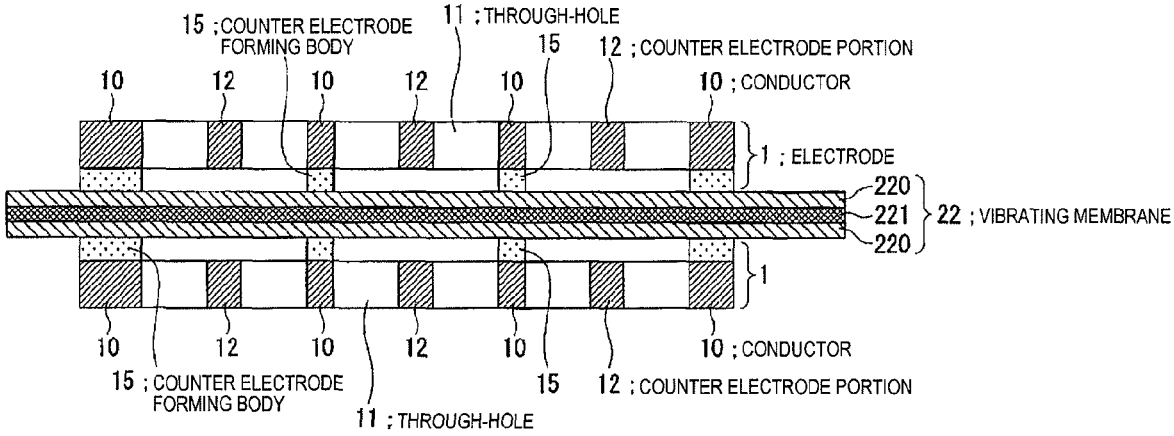
FIG. 6 is a diagram illustrating an assembled state of an ultrasonic transducer according to an embodiment of the invention.

FIG. 6 is a diagram illustrating an assembled state of an ultrasonic transducer according to an embodiment of the invention. In the state shown in FIG. 6, two electrodes 1 are disposed opposite to each other in a vertical direction, and a vibrating membrane (vibration electrode membrane) 22 is interposed between the two electrodes 1. In this case, since the vibrating membrane 22 needs to be insulated from the electrode 1, the vibrating membrane 22 has a metal deposition layer for a conductive layer 221 formed at a central portion of the vibrating membrane 22, and the conductive layer 221 forms a sandwich structure in which both sides of the conductive layer 221 are coated with insulating layers 220 that are high molecular films having excellent insulating resistance. The vibrating membrane 22 is only interposed between the facing electrode forming bodies 15 of the electrodes 1 facing each other, and in the region where the counter electrode portions 12 exist, a predetermined gap is formed between the electrode and the vibrating membrane 22.

As such, the ultrasonic transducer (electrostatic ultrasonic transducer) according to the embodiment of the invention includes a electrode (first electrode) 1 that has through-holes 11, another electrode (second electrode) 1 that has through-holes 11, and a vibrating membrane 22 that is disposed such that the through-hole 11 of the first electrode 1 and the through-hole 11 of the second electrode 1 form a pair, is interposed between a pair of electrodes composed of the first electrode 1 and the second electrode 1, and has a conductive layer 221 applied with a direct current bias voltage, as shown in FIG. 6. Each of the first electrode 1 and the second electrode 1 has counter electrode portions 12 that are formed in the through-holes 11 to face the vibrating membrane 22, and a modulated wave, which obtained by modulating a carrier wave in an ultrasonic frequency band with a signal wave in an audible frequency band, is applied between the pair of electrodes 1 and 1.

By using this structure, in the through-holes, the count electrode portions are disposed to face the vibration region of the vibrating membrane (portion of the vibrating membrane that faces the through-holes).

As a result, it is possible to increase the membrane vibration amplitude of the vibration region of the vibrating membrane. Further, when the counter electrode portions are formed in the through-holes, the diameter of the through-hole can be increased. Therefore, the opening ratio can be increased, and the output sound pressure can be improved.

Figure 7A:
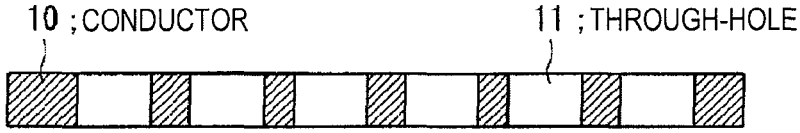
FIGS. 7A to 7C are diagrams illustrating a process for manufacturing a electrode of an ultrasonic transducer according to an embodiment of the invention.
Figure 7B:
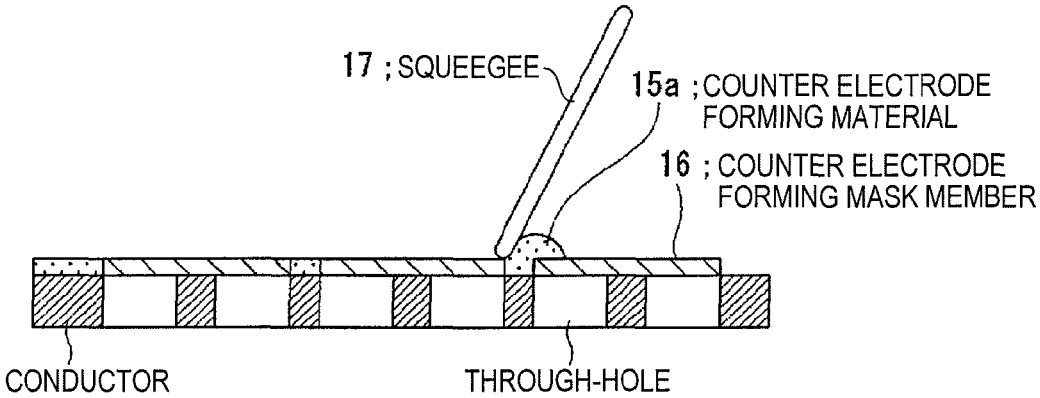
Figure 7C:
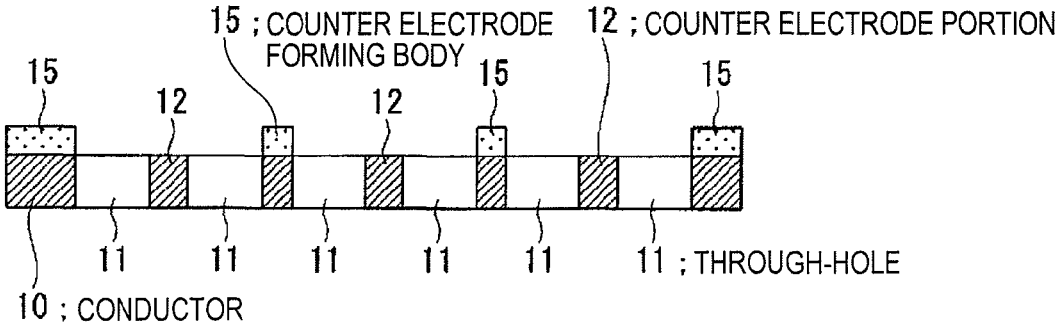

FIGS. 7A to 7C are diagrams illustrating a process for manufacturing a electrode of an ultrasonic transducer according to an embodiment of the invention. Hereinafter, a process for manufacturing the electrode will be described with reference to FIGS. 7A to 7C.

First, as shown in FIG. 7A, the conductor 10 is prepared which is formed by an etching process and a bonding process and becomes a electrode base material.

Then, as shown in FIG. 7B, a mask member 16 becoming a screen to form a counter electrode forming body and a liquid counter electrode forming material 15*a* are set to the conductor 10, and the counter electrode forming material 15*a* is coated on an entire surface of the mask while the squeegee 17 is moved.

In this case, the effective counter electrode forming material 15*a* is a material that can be permanently constructed as the counter electrode forming body 15 and has a non-conductive property. For example, the effective counter electrode forming material 15*a* is a masking ink that is used as liquid solder resist for packaging or resist for sand blast that is generally used in a circuit board.

In particular, since solder resist for a flexible printed circuit board is relatively flexible (has hardness in a range of HB to 3H like a pencil), the solder resist is superior in the adhesion strength with various conductors (conductive resin or the like) including a metal, and is very effective in an interposed property of a vibration electrode membrane made of a high molecular film.

Then, as shown in FIG. 7C, if the mask member 16 serving as the mask plate for forming the counter electrode is separated after the counter electrode forming material 15*a* is completely coated, a non-conductive layer (that is, counter electrode forming body 15) remains on the other portions excluding the counter electrode portion 12. By drying the remaining non-conductive layer, a desired electrode is formed.

Next, examples of specifications of the counter electrode portion according to the embodiment of the invention, and wavelengths and effects in the specifications will be described. In theory, when the sound pressure characteristic is evaluated on the assumption that the membrane vibration is a piston vibration, if the membrane vibration amplitude is increased twice, a work volume is increased twice. As a result, the sound pressure is increased by about 6 dB.

Figure 16A:
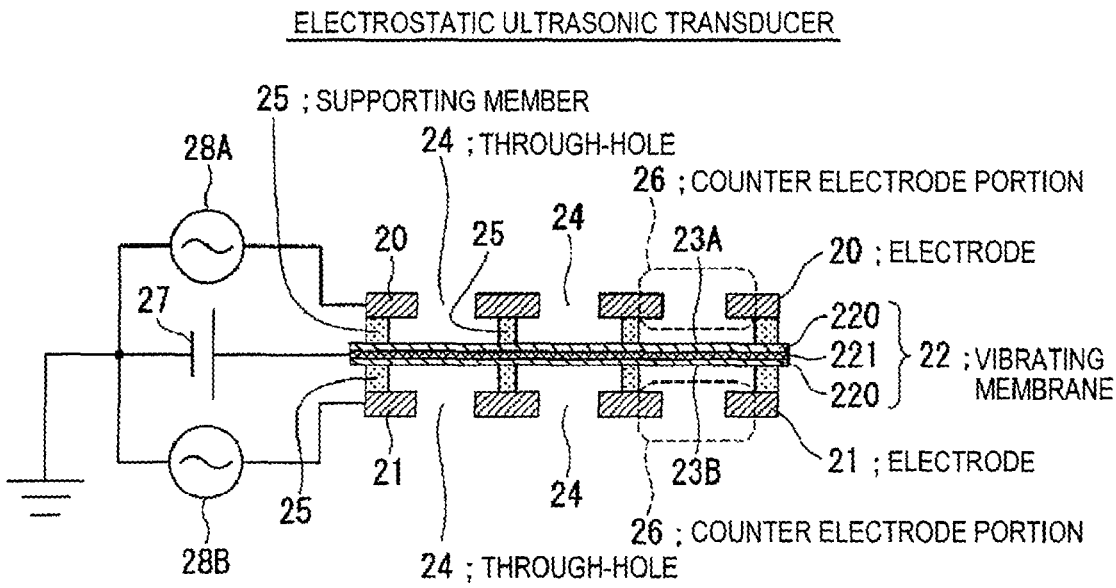
FIG.16A PRIOR ART
FIGS. 16A and 16B are diagrams illustrating an example of a push-pull type electrostatic ultrasonic transducer according to the prior art.
Figure 16B:
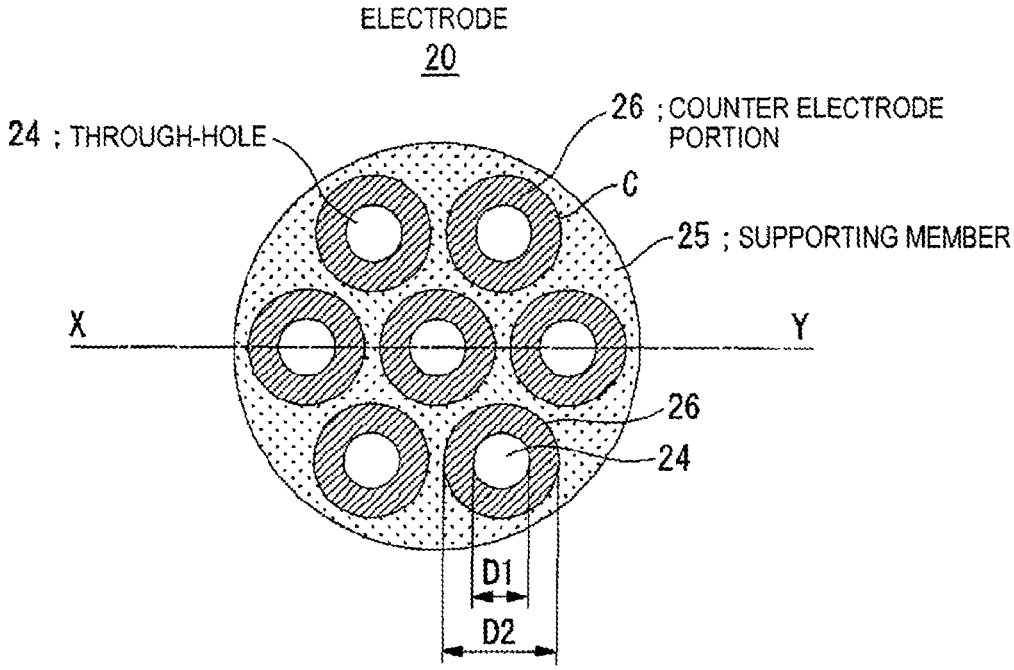
FIG.16B PRIOR ART
Figure 17:
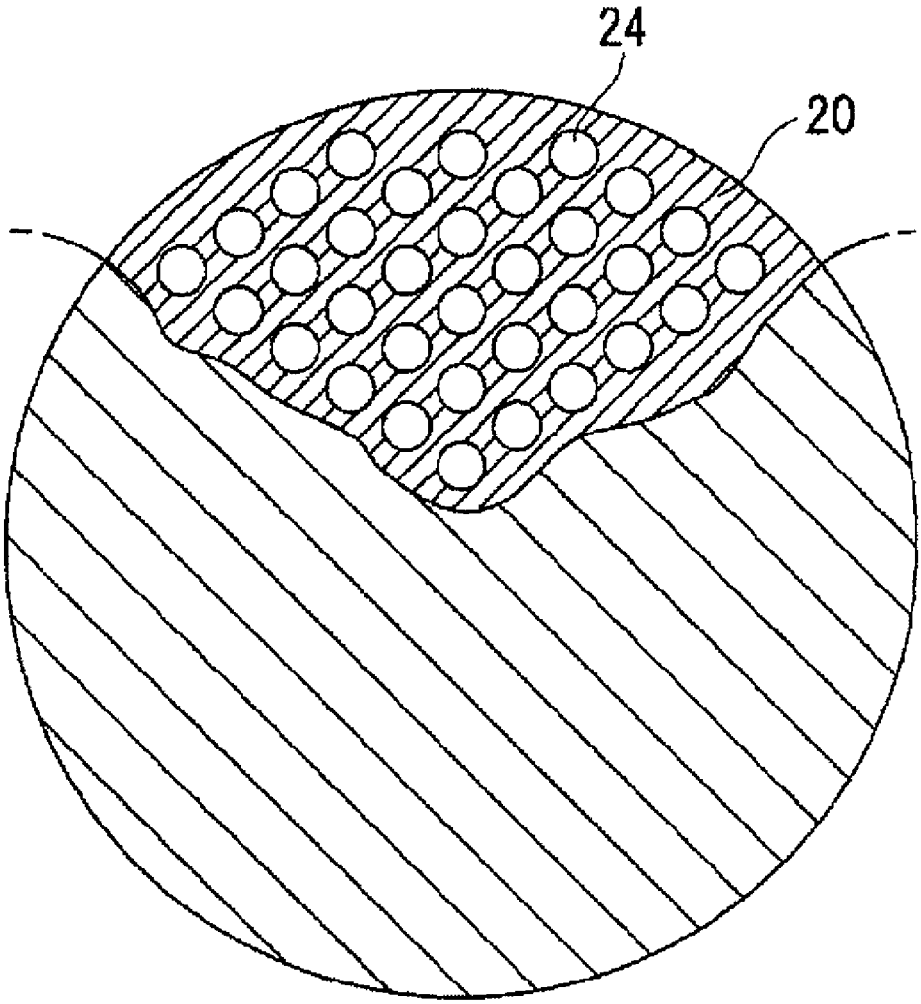
FIG. 17 is a diagram illustrating an aspect of arrangement of through-holes in a electrode.

In all of the counter electrode portions according to the embodiment of the invention, the maximum displacement of the membrane vibration is increased, as compared with the case according to the related art (see FIGS. 16A and 16B). However, since the counter electrode portion may hinder the sound wave radiation, the maximum displacement cannot be evaluated. Accordingly, with respect to a specification of each counter electrode portion, a work volume by the membrane vibration is evaluated (calculated) by the exclusion air volume (that is, exclusion volume).

FIGS. 8A and 8B are diagrams illustrating an example of a specification of a counter electrode portion and an evaluation condition. Specifically, a specification of each counter electrode portion is shown in FIG. 8A, and an evaluation condition is shown in FIG. 8B. Further, it is assumed that an electrostatic force only acts in a region of the vibrating membrane that faces a counter electrode portion.

In the specifications shown in FIG. 8A, the general specification is associated with the specification of the electrode of the shape shown in FIG. 16B, the diameter D2 of the counter electrode portion 26 satisfies the condition 'f=1.5 mm', and the diameter D1 of the hole (through-hole 24) satisfies the condition 'f=0.75 mm'. Further, in the general specification, the counter electrode portion does not exist at the central portion of the hole.

The first form of the invention is associated with the electrode 1 of the shape shown in FIG. 3A. In the first form, the counter electrode portions 12 having a cross-shaped bridge structure are disposed in the holes (through-holes 11). In the first form, the diameter of the counter electrode (length of the bridge crossing the through-hole 11) is the same as the diameter (that is, f=1.5 mm) of the external shape of the holes.

The second form of the invention is associated with the electrode 2 of the shape shown in FIG. 3B. In the second form, the counter electrode portions 13, which have a cross-shaped bridge structure and have the central portions where the central counter electrode portions 13*a* having the diameter (f=0.5 mm) are formed, are disposed in the holes (through-holes 11). In the second form, the diameter of the counter electrode (length of the bridge crossing the through-hole 11) is the same as the diameter (that is, f=1.5 mm) of the external shape of the hole.

The third form of the invention is associated with the electrode 3 of the shape shown in FIG. 4. In the third form, the counter electrode portions 14 having a Y-shaped bridge structure are disposed in the holes (through-holes 11). In the third form, the diameter of the counter electrode (length of the bridge crossing the through-hole 11) is the same as the diameter (that is, f=1.5 mm) of the external shape of the hole.

Further, as shown in FIG. 8B, as evaluation conditions, the thickness of the vibrating membrane, a physical property of the vibrating membrane (young's modulus, Poisson's ratio, and density), and an electrostatic force applied to the vibrating membrane are determined.

Figures 9A, 9B:
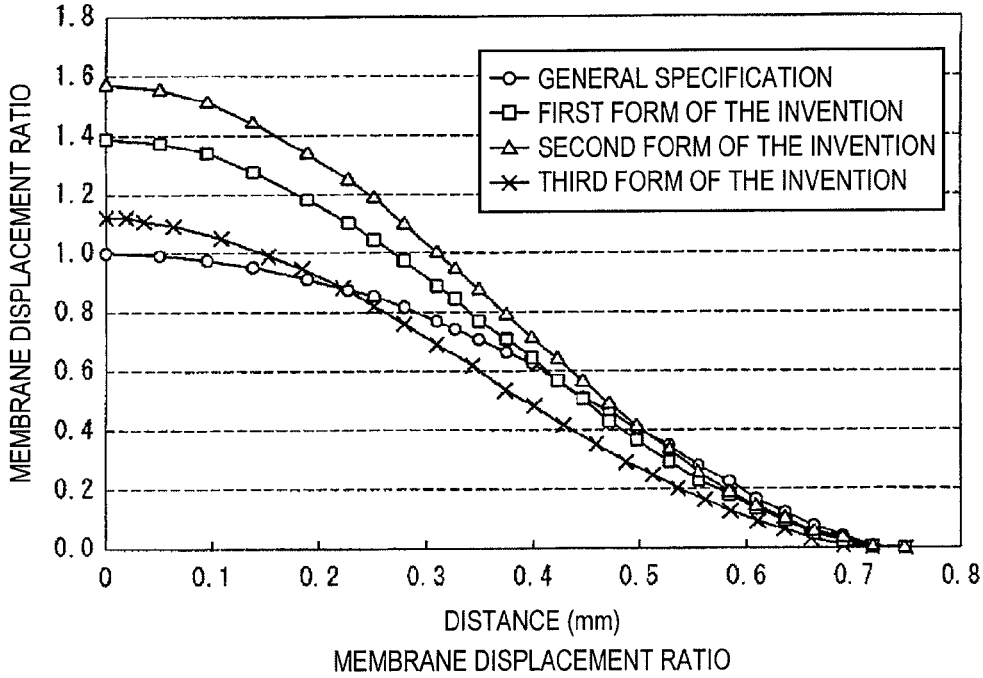
FIGS. 9A and 9B are diagrams illustrating a variation of a membrane displacement ratio of a counter electrode portion in each evaluation device.

FIGS. 9A and 9B are diagrams illustrating a variation of a membrane displacement ratio at each evaluation location of a counter electrode portion. Specifically, In FIG. 9A, the distance 0 mm in the horizontal axis corresponds to a central portion (that is, the center of the vibrating membrane) of the counter electrode portion, and the distance 0.75 mm corresponds to an outer circumferential edge of the counter electrode portion. Further, the film displacement ratio indicates a ratio based on a value (=1) in the general specification (see FIGS. 16A and 16B).

Further, the evaluated result is shown in FIG. 9B. In regards to the vibrating membrane displacement, FIG. 9B shows a maximum vibrating membrane displacement at each of the central portion of the vibrating membrane and the hole of the electrode. In this case, the membrane displacement of the electrode hole indicates a membrane displacement in a region close to a substantially central portion as the portion where the counter electrode portion does not hinder the sound wave radiation. Further, similar to FIG. 9A, the vibrating membrane displacement and the exclusion volume are shown by a ratio based on the value (=1) in the general specification.

According to the general specification, since the central portion of the vibrating membrane corresponds to the central portion of the hole, the absolute displacement of the vibrating membrane is the same. Meanwhile, in the first, second, and third forms of the invention, the counter electrode portion exists at the central portion of the vibrating membrane. As can be understood from FIG. 9A, the maximum amplitude of the vibrating membrane is increased, as compared with the general specification (see FIGS. 16A and 16B), and it is natural that the vibration amplitude is increased in the second form of the invention (see FIG. 3B) in which the area of the central counter electrode is large. However, since the counter electrode portion hinders the sound wave radiation, it is appropriate to compare the vibration amplitudes at the holes of the electrodes.

From the graph shown in FIG. 9A, it can be understood that a value obtained by calculating the maximum displacement in the region where the counter electrode portion does not hinder the sound wave radiation is a value of an electrode hole shown in FIG. 9B. However, even if the absolute displacement of the electrode hole is small as compared with that of the central portion of the vibrating membrane, in the case of the cross-shaped bridge, the maximum displacement is large by 10 to 20%, as compared with the general specification. Further, the maximum displacement in the Y-shaped bridge structure is the same as that of the general specification.

If comparing the exclusion volumes that are calculated from the membrane displacement of the electrode hole shown in FIG. 9A in each evaluating device and discharged from the electrode hole, in the first to third forms, the exclusion volume is increased, as compared with the general specification. In particular, in the cross-shaped bridge structure, the membrane displacement is increased twice or more in the first form of the invention (see FIG. 3A). As a result, the sound pressure can be increased by 6 dB or more. The reason why the sound pressure is increased is because the sound wave can be more effectively discharged by the fact that the absolute displacement of the electrode opening is large by 20% as compared with the general specification and the opening ratio is increased by about 68% (about 2.7 times) with respect to 25% in the general specification.

Further, an opening ratio is defined as 'opening ratio= (through-hole area)/(counter electrode portion area+through-hole area'). For example, the opening ratio in the electrode 20 according to the related art shown in FIG. 16B corresponds to a ratio of an area of the through-hole 24 shown in void at a strip black part in the drawing with respect to an entire area of the inner side of an outline C of the counter electrode portion 26. That is, the opening ratio is 25% in the example shown in FIG. 16B. In the bridge structure according to the embodiment of the invention, for example, in each small hole in FIG. 3A, the opening ratio in the electrode 20 corresponds to a ratio of an area of the through-hole 11 with respect to an entire area of the inner side of the outline C of the through-hole 11 (divided into four regions) shown in void at a strip black part in the drawing.

Further, in the third form of the invention that has the Y-shaped bridge structure (see FIG. 4), the maximum displacement is increased by 2.9 times as compared with that in the general specification, and the sound pressure can be increased by about 9 dB. In this case, the maximum factor that causes the sound pressure to increase even though the membrane displacement is almost the same as that in the general specification is an opening ratio (about 78%). Specifically, this is because the opening ratio is increased to three times the opening ratio in the general specification and is increased by 10% as compared with the opening ratio in the cross-shaped bridge structure, and the sound wave is more effectively radiated.

From the above-described result, if the counter electrode portion has the bridge structure and the minimally required counter electrode portions are disposed in the center portion of the vibrating membrane, the effective membrane displacement can be increased, and the loss of the sound wave radiation can be minimally suppressed. As a result, it is possible to increase the exclusion volume of the air discharged due to the membrane vibration twice or more, which increases the sound pressure by 6 dB or more.

Figure 10:
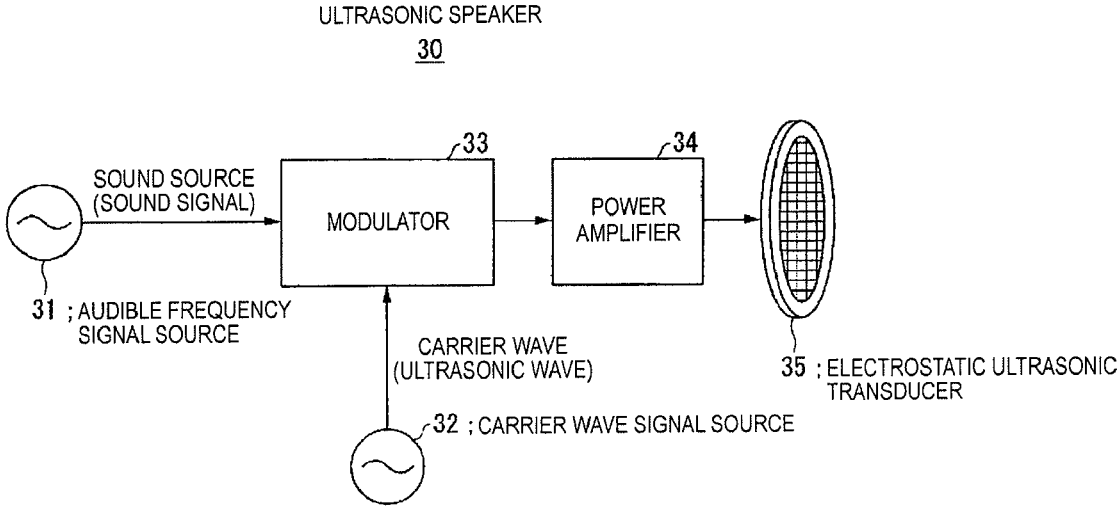
FIG. 10 is a diagram illustrating an ultrasonic speaker using an ultrasonic transducer according to an embodiment of the invention.

FIG. 10 is a diagram illustrating an example of a structure of an ultrasonic speaker that uses an electrostatic ultrasonic transducer according to an embodiment of the invention. The ultrasonic speaker subjects the ultrasonic wave referred to as a carrier wave to AM modulation by using a sound signal (audible frequency signal) and discharges the ultrasonic wave to the air, the original sound signal is reproduced in the air due to the non-linearity of the air. That is, since the sound wave is a compression wave that propagates using the air as the medium, while the modulated ultrasonic wave propagates, the dense portion and the sparse portion of the air are distinguished, and the sound speed is high in the dense portion and the sound speed is low in the sparse portion. As a result, the distortion occurs in the modulated wave, the sound wave is separated into the carrier wave (ultrasonic wave) and the audible wave (original sound signal), and a person can only hear an audible sound (original sound signal) of 20 KHz or less. This is generally referred to as a parametric array effect.

The ultrasonic speaker 30 shown in FIG. 10 includes an audible frequency signal source (sound signal source) 31 that generates a signal wave of an audible frequency band, a carrier wave signal source 32 that generates a carrier wave of an ultrasonic frequency band and outputs it, a modulator 33, a power amplifier 34, and an electrostatic ultrasonic transducer 35 according to an embodiment of the invention.

In this case, in this specification, the 'audible frequency band' means a frequency band of less 20 KHz, and the 'ultrasonic frequency band means a frequency band of 20 KHz or more.

In this structure, by the sound signal wave output from the audible frequency signal source 31, the carrier wave of the ultrasonic frequency band output from the carrier wave signal source 32 is modulated by the modulator 33, and the electrostatic ultrasonic transducer 35 is driven by the modulated signal amplified by the power amplifier 34. As a result, the modulated signal is converted into a sound wave of a finite vibration amplitude level by the electrostatic ultrasonic transducer 35, the sound wave is radiated through the medium (air), and the original audible frequency band signal sound is reproduced by the non-linearity of the medium (air).

In the ultrasonic speaker 30, the electrostatic ultrasonic transducer 35 according to the embodiment of the invention is used, and it is possible to radiate the ultrasonic wave of the high sound pressure, as compared with the ultrasonic speaker according to the related art.

As described above, in the electrostatic ultrasonic transducer according to the embodiment of the invention, the counter electrode portion has the bridge structure, and the counter electrode portion is disposed on the central portion of the vibration region of the vibrating membrane. Further, the bridge structure is set to the cross-shaped structure or the Y-shaped structure. As a result, the counter electrode potion is disposed on the central portion of the vibration region to increase the membrane vibration amplitude, and the counter electrode portion does not hinder the ultrasonic wave radiation. In this way, the opening ratio can be increased, which improves the sound pressure.

Example of Structure of Super-directivity Sound System According to Embodiment of the Invention Next, an electrostatic ultrasonic transducer according to an embodiment of the invention, that is, a super-directivity sound system will be described in which a speaker including a push-pull type electrostatic ultrasonic transducer is used. The ultrasonic directivity sound system includes a first electrode that has through-holes, a second electrode that has through-holes, and a vibrating membrane that is disposed such that the through-hole of the first electrode and the through-hole of the second electrode form a pair, interposed between a pair of electrodes composed of the first electrode and the second electrode, and having a conductive layer applied with a direct current bias voltage. Each of the first electrode and the second electrode has counter electrode portions that is disposed in the through-holes in a direction facing the vibrating membrane, and a modulated wave c, which is by modulating a carrier wave in an ultrasonic frequency band by a signal wave in an audible frequency band, is applied between the pair of electrodes.

Hereinafter, a projector that is an example of an ultrasonic directivity sound system according to an embodiment of the invention will be described. Further, the super-directivity sound system according to the embodiment of the invention is not limited to the projector, but can be widely applied to a display device that is capable of reproducing a sound and an image.

Figure 11:
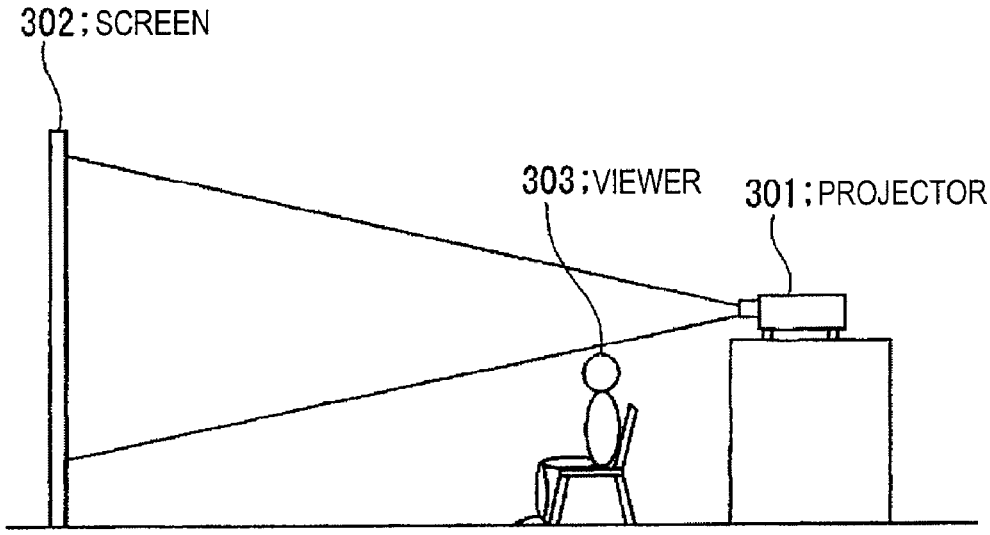
FIG. 11 is a diagram illustrating a used state of a projector according to an embodiment of the invention.

FIG. 11 is a diagram illustrating a used state of a projector according to an embodiment of the invention. As shown in FIG. 11, the projector 301 is disposed in the back of the viewer 303, and projects an image onto a screen 302 disposed in front of the viewer 303. The projector 301 forms a virtual sound source on a projection surface of the screen 302 by the ultra speaker mounted on the projector 301, and reproduces the sound source.

Figure 12A:
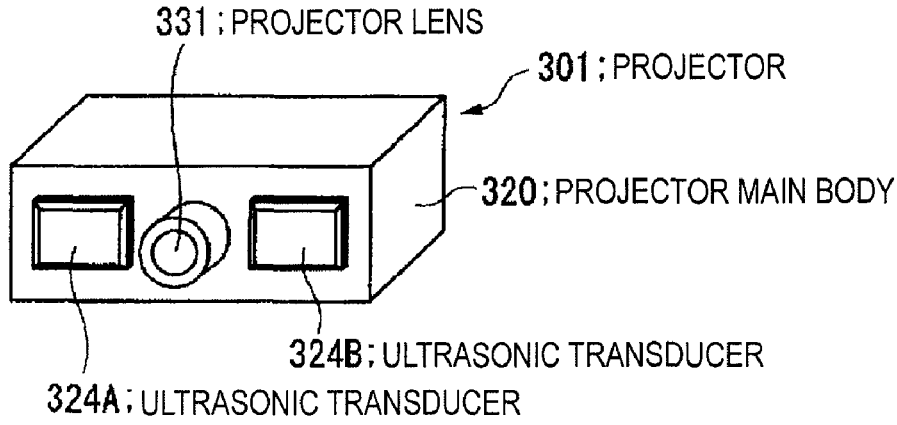
FIGS. 12A and 12B are diagrams illustrating an external structure of a projector shown in FIG. 11.
Figure 12B:
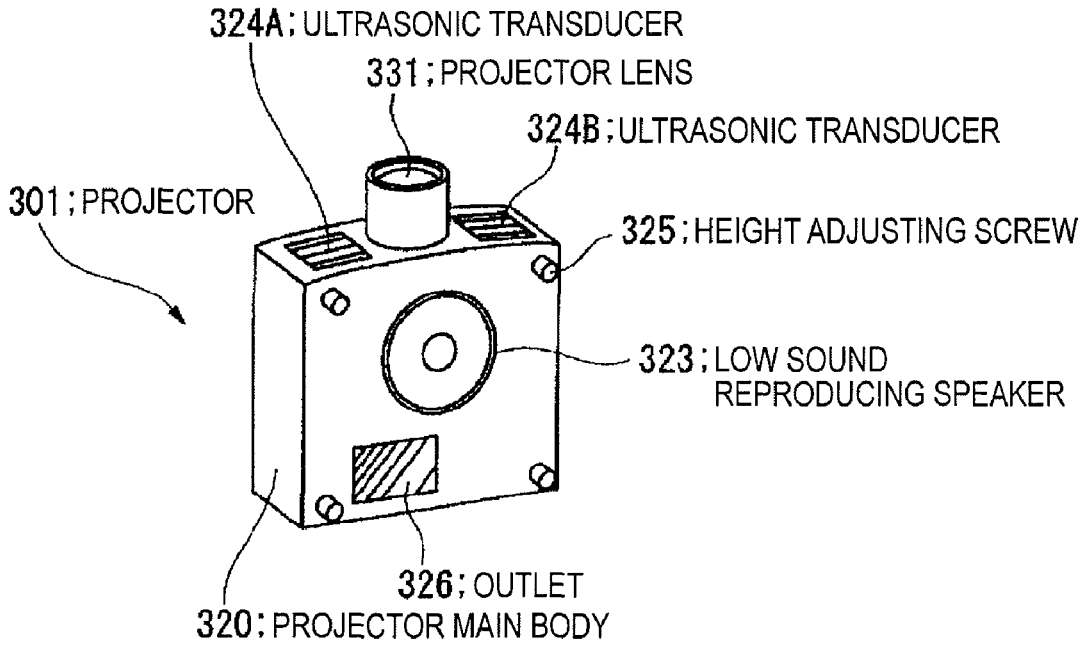

FIGS. 12A and 12B are diagrams an external structure of the projector 301. As shown in FIGS. 12A and 12B, the projector 301 includes a projector main body 320 that includes a projection optical system that projects an image onto a projection surface, such as a screen, ultrasonic transducers 324A and 324B that are capable of oscillating a sound wave in an ultrasonic frequency band, and an ultrasonic speaker that reproduces a signal in an audible frequency band from a sound signal supplied from the sound source, which are integrally constructed. In this embodiment, in order to reproduce the stereo sound signal, ultrasonic transducers 324A and 324B are mounted on the projector main body. The ultrasonic transducers 324A and 324B interpose a projector lens 331 forming a projection optical system and form ultrasonic speakers at the left and right sides.

Furthermore, a low sound reproducing speaker 323 is provided on the bottom surface of the projector main body 320. Reference numeral 325 indicates a height adjusting screw that adjusts the height of a projector main body 320, and reference numeral 326 indicates an outlet for a cooling fan.

Further, the projector 301 uses a push-pull type electrostatic ultrasonic transducer according to an embodiment of the invention that serves as an ultrasonic transducer forming an ultrasonic speaker, and can oscillate a sound signal in an ultrasonic wave frequency band (sound wave in an ultrasonic frequency band) with a high sound pressure. For this reason, it is possible to achieve a sound effect that is obtained in a stereo surround system or a 5.1 ch surround system by increasing a spatial reproducing range of a reproducing signal in an audible frequency band by changing a carrier frequency without requiring a large-sized sound system that is generally needed, and it is possible to achieve a projector having superior portability.

Figure 13:
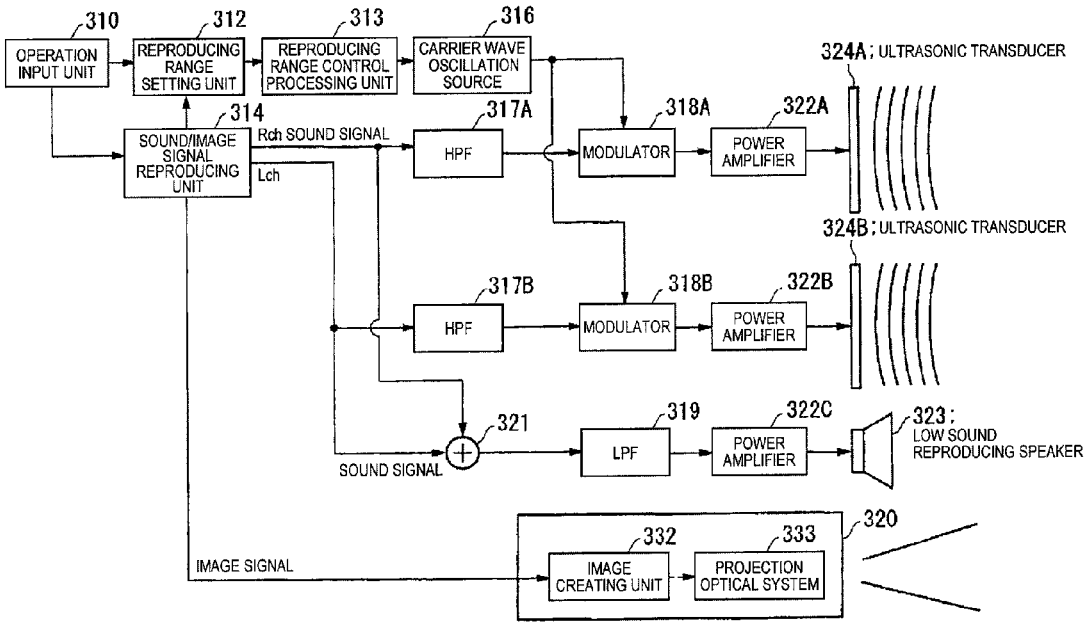
FIG. 13 is a diagram illustrating an electrical structure of a projector shown in FIG. 11.

FIG. 13 shows an electrical structure of a projector 301. The projector 301 includes an ultrasonic speaker that includes an operation input unit 310, a reproducing range setting unit 312, a reproducing range control processing unit 313, a sound/image signal reproducing unit 314, a carrier wave oscillating source 316, modulators 318A and 318*b*, power amplifiers 322A and 322B, and electrostatic ultrasonic transducers 324A and 324B, bypass filters 317A and 317B, a low pass filter 319, an adder 321, a power amplifier 322C, a low sound reproducing speaker 323, and a projector main body 320. Further, the electrostatic ultrasonic transducers 324A and 324B are the push-pull type electrostatic ultrasonic transducers according to the embodiment of the invention.

The projector 320 includes an image generating unit 332 that generates video, and a projection optical system 333 that projects the generated image onto a projection surface. The projector 301 includes an ultrasonic speaker and a low sound reproducing speaker 323, and a projector main body 320, which are integrally provided.

The operation input unit 310 has various functional keypads that include a numerical keypad, a numbered keypad, and a power supply keypad for turning on and off a power supply. The reproducing range setting unit 312 is constructed such that data designating a reproducing range of a reproducing signal (signal source) can be input by operating the keypads in the operation input unit 310. In the reproducing range setting unit 312, if the data is input, a frequency of a carrier wave defining the reproducing range of the reproducing signal is set, and is held. The reproducing range of the reproducing signal is set by designating the distance until the reproducing signal reaches from the sound wave radiating surfaces of the ultrasonic transducers 324A and 324B in a radial axis direction.

Further, the reproducing range setting unit 312 is constructed such that a carrier frequency can be set by a control signal output from the sound/image signal reproducing unit 314 according to the display contents.

Further, the reproducing range control processing unit 313 has a function of referring the image contents from the reproducing range setting unit 312 and controlling the carrier wave oscillating source 316 to change the carrier frequency generated by the carrier wave oscillating source 316 to become the set reproducing range.

For example, when the carrier frequency is set to 50 KHz as internal information of the reproducing range setting unit 312, the reproducing range control processing unit 313 controls the carrier wave oscillating unit 316 such that the carrier wave oscillating unit 316 oscillates at a frequency of 50 KHz.

The reproducing range control processing unit 313 has a storage unit that stores a table indicating a relationship between the distance until the reproducing signal reaches from the sound wave radiating surfaces of the ultrasonic transducers 324A and 324B defining the reproducing range in a radial axis direction, and the carrier frequency. The data in the table is obtained by measuring the relationship between the carrier frequency and the reproducing signal reaching distance.

The reproducing range control processing unit 313 calculates a carrier wave according to the distance information set by referring to the table on the basis of the set contents of the reproducing range setting unit 312, and controls the carrier wave oscillating source 316 so as to become the corresponding frequency.

The sound/image signal reproducing unit 314 is a DVD player that uses a DVD as a recording medium. The sound signal of an R channel among the reproduced sound signals is output to the modulator 318A through the bias filter 317A, the sound signal of the L channel is output to the modulator 318A through the bypass filter 317B, and the image signal is output to the image reproducing unit 332 of the projector main body 320.

Further, the sound signal of the R channel and the sound signal of the L channel that are output from the sound/image signal reproducing unit 314 are synthesized by an adder 321, and are input to the power amplifier 322C through the low pass filter 319. The sound/image signal reproducing unit 314 corresponds to a sound source.

The bypass filters 317A and 317B have characteristics of making the frequency components of the sound signals of the R channel and the L channel only pass through the bypass filters 317A and 317B. Further, the low pass filter has characteristics of making the frequency components of the sound signals of the R channel and the L channel only pass through the low pass filter.

Accordingly, the sound signals in the intermediate and high sound area among the sound signals of the R channel and the L channel are reproduced by the ultrasonic transducers 324A and 324B, and signals in the low sound area among the sound signals of the R channel and the L channel are reproduced by the low sound reproducing speaker 323.

Further, the sound/image signal reproducing unit 314 is not limited to the DVD player, but may be a reproducing device that reproduces a sound signal input from the outside. Further, the sound/image signal reproducing unit 314 has a function of outputting a control signal indicating a reproducing range to a reproducing range setting unit 312, in order to dynamically change the reproducing range of the reproducing sound such that the sound effect according to the reproduced image scene can be achieved.

The carrier wave oscillating source 316 has a function of generating a carrier wave of a frequency in an ultrasonic frequency band that is instructed by the reproducing range setting unit 312 and outputting it to the modulators 318A and 318B.

The modulators 318A and 318B have a function of subjecting the carrier wave supplied from the carrier wave oscillating unit 316 to AM modulation by using a sound signal of the audible frequency band output from the sound/image signal reproducing unit 314, and outputting the modulated signals to the power amplifiers 322A and 322B, respectively.

The ultrasonic transducers 324A and 324B are driven by the modulated signals output from the modulators 318A and 318B through the power amplifiers 322A and 322B, and have a function of converting the modulated signals into sound waves having finite amplitude levels, radiating the sound waves in the medium, and reproducing the signal sources in the audible frequency band (reproducing signals).

The image creating unit 332 has a display such as a liquid crystal display or a plasma display panel (PDP), and a driving circuit that drives the display on the basis of the image signal output from the sound/image signal reproducing signal 314, and creates the image that is obtained from the image signal output from the sound/image signal reproducing unit 314.

The projection optical system 333 has a function of projecting the image displayed on the display onto the projection surface, such as the screen, which is disposed in front of the projector main body 320.

Next, an operation of the projector 301 that has the above-described structure will be described. First, the data (distance information) that indicates the reproducing range of the reproducing signal form the operation input unit 310 when the user operates the keypad is set in the reproducing range setting unit 312, and the reproducing instruction is given to the sound/image signal reproducing unit 314.

As a result, in the reproducing range setting unit 312, distance information defining the reproducing range is set. The reproducing range setting unit 313 receives the distance information set to the reproducing range setting unit 312, refers to the data stored in the storage unit incorporated in the reproducing range setting unit 312, calculates the carrier wave corresponding to the set distance information, controls the carrier wave oscillating unit 316 to generate the carrier wave of the corresponding frequency.

As a result, carrier wave oscillating source 316 generates a plurality of carrier waves corresponding to the distance information set to the reproducing range setting unit 312, and outputs them to the modulators 318A and 318B.

Meanwhile, the sound/image signal generating unit 314 outputs the sound signal of the R channel among the reproduced sound signal to the modulator 318A through the bypass filter 317A, outputs the sound signal of the L channel to the modulator 318B through the bypass filter 317B, outputs the sound signal of the R channel and the sound signal of the L channel to the adder 321, and outputs the image signal to the image creating unit 332 of the projector main body 320.

Accordingly, the sound signals of the intermediate and high sound areas among the sound signals of the R channel are input to the modulator 318 by the bypass filter 317A, and the sound signals of the intermediate and high sound areas among the sound signals of the L channel are input to the modulator 318B by the bypass filter 317B.

Further, the sound signal of the R channel and the sound signal of the L channel are synthesized by the adder 321, and the sound signals of the low sound area among the sound signal of the R channel and the sound signal of the L channel are input to the power amplifier 322C by the low pass filter 319.

The image creating unit 332 drives the display on the basis of the input image signal, and creates and displays the video. The image that is displayed on the display is projected onto the projection surface, that is, the screen 302 shown in FIG. 11, by means of the projection optical system 333.

Meanwhile, the modulator 318A subjects the carrier wave output from the carrier wave oscillating source 316 to AM modulation by using the sound signal of the intermediate and high sound area in the sound signals of the R channel output from the bypass filter 317A, and outputs it to the power amplifier 322A.

Further, the modulator 318B subjects the carrier wave output from the carrier wave oscillating source 316 to AM modulation by using the sound signal of the intermediate and high sound area in the sound signals of the L channel output from the bypass filter 317B, and outputs it to the power amplifier 322B.

The modulated signals that are amplified by the power amplifiers 322A and 322B are applied between the upper electrode 10A and the lower electrode 10B (see FIGS. 1A and 1B) in each of the ultrasonic transducers 324A and 324B. As a result, the modulated signals are converted into the sound waves having finite amplitude levels (sound signals), and are radiated to the medium (air). From the ultrasonic transducer 324A, the sound signals of the intermediate and high sound area in the sound signals of the R channel are reproduced, and from the ultrasonic transducer 324B, the sound signals of the intermediate and high sound area in the sound signals of the L channel are reproduced.

Further, the sound signals of the low sound area in the R channel and the L channel amplified by the power amplifier 322C are reproduced by the low sound reproducing speaker 323.

As described above, when propagating the ultrasonic wave that is radiated into the medium (air) by the ultrasonic transducer, as the ultrasonic wave propagates, a sound speed is high in the portion having the high sound pressure, and the sound speed is delayed in the low sound pressure. As a result, the distortion is generated in the waveform.

When the radiated signal of the ultrasonic wave band (carrier wave) is converted into the signal of the audible frequency band (AM modulation), according to the result of the waveform distortion, the signal wave of the audible frequency band used at the time of modulation is formed in the form where is separated from the carrier wave of the ultrasonic frequency band and is then demodulated. At this time, the expansion of the reproducing signal becomes a beam shape due to the characteristic of the ultrasonic wave, and the sound is generated in a specific direction that is completely different from the general speaker.

The reproducing signal that is output from the ultrasonic transducer 324 forming the ultrasonic speaker and has a beam shape is radiated toward the projection surface (screen) onto which the image is projected by the projection optical system 333, is reflected on the projection surface, and is propagated. At this time, in accordance with the frequency of the carrier wave that is set to the reproducing range setting unit 312, the distance until the reproducing signal is separated from the carrier wave from the sound wave radiating surface of the ultrasonic transducer 324 in a radial axis direction (normal direction), and the beam width (expansion angle of the beam) of the carrier wave are different. Therefore, the reproducing range is varied.

Figure 14:
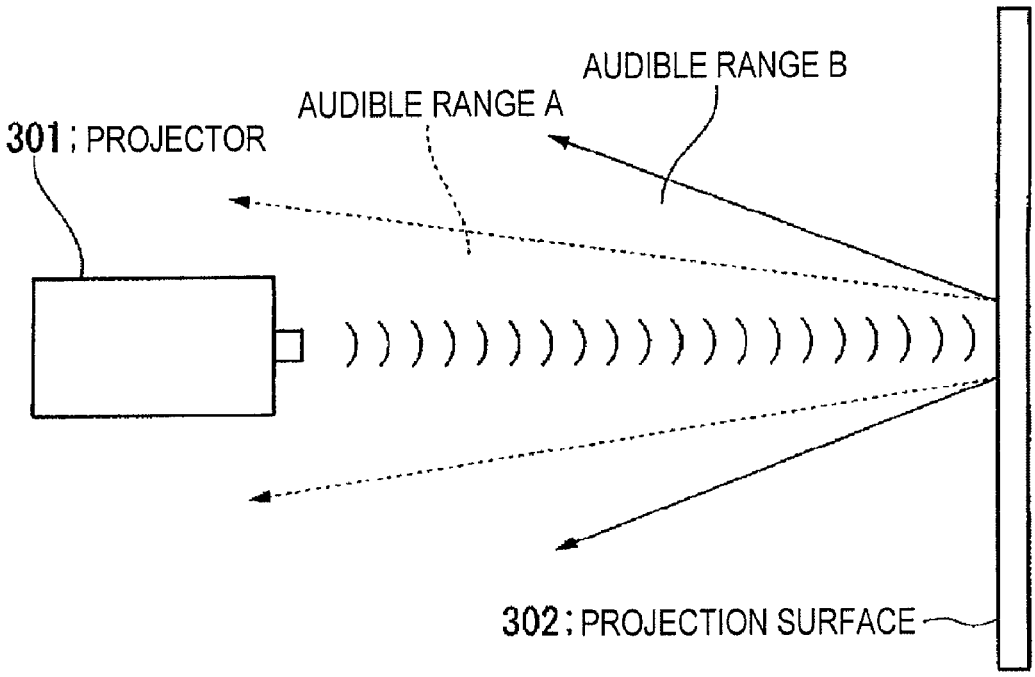
FIG. 14 is a diagram illustrating a reproducing state of a reproducing signal by an ultrasonic transducer.
Figure 15A:
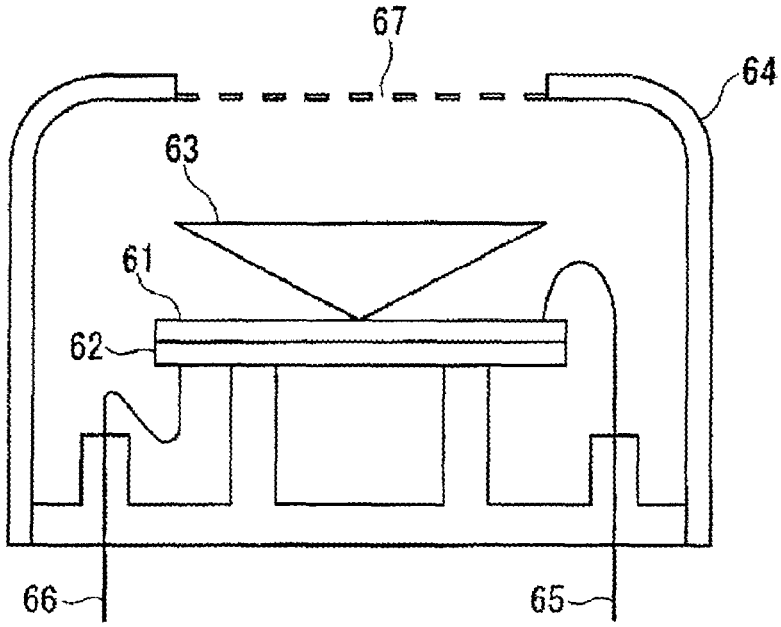
FIG.15A PRIOR ART
FIGS. 15A and 15B are diagrams illustrating an example of a structure of an ultrasonic transducer according to the prior art.
Figure 15B:
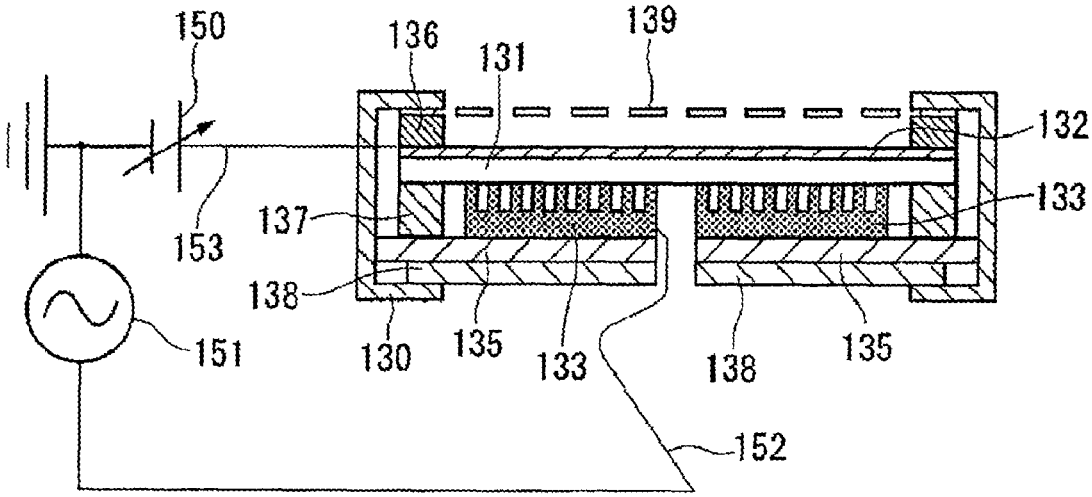
FIG.15B PRIOR ART

FIG. 14 shows a state at the time of reproducing a reproducing signal by an ultrasonic speaker that is constructed by including ultrasonic transducers 324A and 324B in a projector 301. In the projector 301, when the ultrasonic transducer is driven by a modulated signal obtained by modulating the carrier wave by the sound signal, in the case where the carrier frequency set by the reproducing range setting unit 312 is low, the distance until the reproducing signal is separated from the carrier wave from the sound wave radiating surface of the ultrasonic transducer 324 in the radial axis direction (normal direction of the ultrasonic radiating surface), that is, the distance to the reproducing point is reduced.

Accordingly, the beam of the reproducing signal of the audible frequency band that has been reproduced reaches the projection surface (screen) 302 without being diffused, and in this state, it is reflected on the projection surface 302. Therefore, the reproducing range becomes an audible range A shown by a dot-line arrow in FIG. 14, and the reproducing sound (reproducing signal) can only hear in a narrow range that is relatively distant from the projection surface 302.

Meanwhile, when the carrier frequency set by the reproducing range setting unit 312 is higher than the carrier frequency in the above-described case, the sound wave radiated from the ultrasonic radiating surface of the ultrasonic transducer 324 is narrowed more than the case where the carrier frequency is low. However, the distance until the reproducing signal is separated from the carrier wave from the sound wave radiating surface of the ultrasonic transducer 324 in a radial axis direction (normal direction of the sound wave radiating surface), that is, the distance to the reproducing point is reduced.

Accordingly, the beam of the reproducing signal of the audible frequency band that has been reproduced reaches the projection surface 302 with diffused before reaching the projection surface 302, and in this state, it is reflected on the projection surface 302. Therefore, the reproducing range becomes an audible range B shown by a solid-line arrow in FIG. 14, and the reproducing sound (reproducing signal) can only hear in a wide range that is relatively close from the projection surface 302.

As described above, the projector according to the embodiment of the invention uses the ultrasonic speaker using the push-pull type or pull type electrostatic ultrasonic transducer. In the projector, the sound signal has the sufficient sound pressure and the wide band characteristic, and can be reproduced such that it is emitted from the virtual sound source formed in the vicinity of the sound wave reflecting surface, such as the screen.

For this reason, the reproducing range can be easily controlled. Further, the electrostatic ultrasonic transducer is controlled such that the vibration region of the vibrating membrane is divided into a plurality of blocks, and a phase of the alternating current signal applied between the electrode layer of the vibrating membrane and each block of the electrode pattern for vibration is allowed to have a predetermined phase difference between neighboring blocks. In this way, it is possible to control the directivity of the sound that is radiated from the ultrasonic speaker.

Further, the projector according to the embodiment of the invention uses the push-pull type electrostatic ultrasonic transducer constructed such that the pair of electrodes have the counter electrode portions with respect to the central portion of the vibration region of the vibrating membrane or the peripheral portion of the central portion, that is, the counter electrode portions are disposed in the through-holes to face the vibration region of the vibrating membrane (portion of the vibrating membrane facing the through-holes).

Therefore, it is possible to increase the membrane vibration amplitude of the vibration region of the vibrating membrane. Further, the counter electrode portions are formed in the through-holes, and thus the diameter of the through-hole can be increased. As a result, the opening ratio can be increased, and the output sound pressure can be improved. Accordingly, a strong ultrasonic wave can be generated over the wide frequency band, and the sound quality of the reproducing sound can be improved.

The preferred embodiment of the invention has been described. However, the electrostatic ultrasonic transducer and the ultrasonic speaker according to the embodiment of the invention are not limited to the above-described example, and various changes and modifications can be made without departing from the spirit and scope of the invention.

The preferred embodiment of the invention has been described. However, the electrostatic ultrasonic transducer according to the embodiment of the invention is not limited to the above-described example, and various changes and modifications can be made without departing from the spirit and scope of the invention.

The entire disclosure of Japanese Patent Application Nos: 2006-043484, filed Feb. 21, 2006 and 2007-018182, filed Jan. 29, 2007 are expressly incorporated by reference herein.

What is claimed is:

1. An ultrasonic speaker comprising:

an electrostatic ultrasonic transducer that includes a first electrode that has through-holes, a second electrode that has through-holes, and a vibrating membrane that is disposed such that the through-holes of the first electrode and the through-holes of the second electrode form a pair, interposed between the first electrode and the second electrode, and having a conductive layer applied with a direct current bias voltage, the first electrode and the second electrode each having counter electrode portions that are formed in the through-holes to face the vibrating membrane, a modulated wave obtained by modulating a carrier wave in an ultrasonic frequency band with a signal wave in an audible frequency band being applied between the pair of electrodes;

a signal source that generates the signal wave in the audible frequency band;

a carrier wave supply unit that generates the carrier wave in the ultrasonic frequency band and outputs the carrier wave; and a modulating unit that modulates the carrier wave with the signal wave in the audible frequency band output by the signal source, wherein the electrostatic ultrasonic transducer is driven by a modulated signal that is applied between the first electrode and the second electrode and an electrode layer of the vibrating membrane and is output from the modulating unit.

2. The ultrasonic speaker according to claim 1, wherein the counter electrode portions of the electrostatic ultrasonic transducer have a bridge structure that builds a bridge between an outer circumferential portion and an inner portion of the through-hole.

3. The ultrasonic speaker according to claim 2, wherein the bridge structure is a cross-shaped structure.

4. The ultrasonic speaker according to claim 3, wherein a central counter electrode portion, which is wider than the bridge structure, is provided at a central portion of the cross-shaped structure.

5. The ultrasonic speaker according to claim 3, wherein the bridge structure is a Y-shaped structure.

6. The ultrasonic speaker according to claim 1, wherein the audible frequency band is a frequency band of less than 20 KHz, and the ultrasonic frequency band is a frequency band of 20 KHz or more.

* * * * *